US008019601B2

(12) United States Patent
Eguchi

(10) Patent No.: US 8,019,601 B2
(45) Date of Patent: Sep. 13, 2011

(54) AUDIO CODING DEVICE WITH TWO-STAGE QUANTIZATION MECHANISM

(75) Inventor: Nobuhide Eguchi, Fukuoka (JP)

(73) Assignee: Fujitsu Semiconductor Limited, Yokohama (JP)

( * ) Notice: Subject to any disclaimer, the term of this patent is extended or adjusted under 35 U.S.C. 154(b) by 1011 days.

(21) Appl. No.: 11/902,770

(22) Filed: Sep. 25, 2007

(65) Prior Publication Data

US 2008/0077413 A1 Mar. 27, 2008

(30) Foreign Application Priority Data

Sep. 27, 2006 (JP) ..... 2006-262022

(51) Int. Cl.
*G10L 21/00* (2006.01)
*G10L 19/00* (2006.01)
*G10L 21/04* (2006.01)

(52) U.S. Cl. ..... 704/230; 704/200; 704/500; 704/503

(58) Field of Classification Search ..... 704/200–201, 704/219, 221–230, 500–504
See application file for complete search history.

(56) References Cited

U.S. PATENT DOCUMENTS 4,811,398 A * 3/1989 Copperi et al. ..... 704/230
5,765,127 A * 6/1998 Nishiguchi et al. ..... 704/208
6,487,535 B1 * 11/2002 Smyth et al. ..... 704/500
6,542,863 B1 * 4/2003 Surucu ..... 704/200.1
7,340,394 B2 * 3/2008 Chen et al. ..... 704/230
7,343,291 B2 * 3/2008 Thumpudi et al. ..... 704/500
7,644,002 B2 * 1/2010 Thumpudi et al. ..... 704/500
7,668,715 B1 * 2/2010 Chaugule et al. ..... 704/230
2005/0015246 A1 * 1/2005 Thumpudi et al. ..... 704/229

OTHER PUBLICATIONS

Weishart et al. Two-pass encoding of audio material using mp3 compression. AES paper 5687. Oct. 5-8, 2002.*
Bosi et al. ISO/IEC MPEG-2 Advanced Audio Coding. J. Audio Eng.l Soc., vol. 45, No. 10, Oct. 1997.*
Bauer, Claus. Joint optimization of scale factors and huffman code books for MPEG-4 AAC. IEEE Transactions on Signal Processing, vol. 54, No. 1 Jan. 2006.*
Patent Abstract of Japan, Japanese Publication No. 2002-196792, Published Jul. 12, 2002.

* cited by examiner

*Primary Examiner* — James S. Wozniak
*Assistant Examiner* — Matthew Baker
(74) *Attorney, Agent, or Firm* — Staas & Halsey LLP

(57) ABSTRACT

An audio coding device that optimizes quantization parameters for fast convergence of iterations. A quantized bit counter calculates a codeword length representing the number of bits of a Huffman codeword corresponding to quantized values. The quantized bit counter also calculates a codebook number bit count representing how many bits are consumed for optimal Huffman codebook numbers, and a scale factor bit count representing how many bits are consumed for scale factors of each subband. In a first stage of quantization, the quantized bit counter accumulates lengths of Huffman codewords corresponding to quantized values of every nth subband. A bit count estimator calculates a total bit count estimate by adding up n times the accumulated codeword length, the codebook number bit count, and the scale factor bit count. A parameter updater updates quantization parameters if the total bit count estimate exceeds a bit count limit.

12 Claims, 25 Drawing Sheets

FIG. 8

(NA: Not Available)

| | Q[0] | Q[1] | Q[2] | Q[3] | Q[4] | Q[5] | Q[6] | Q[7] | Total Codeword Length |
|---|---|---|---|---|---|---|---|---|---|
| | -1 | 0 | -2 | 1 | 2 | -1 | 1 | 0 | |
| Codebook#1,2 Index | (NA) | | | | (NA) | | | | (NA) |
| Codebook#1 Codeword | (NA) | | | | (NA) | | | | (NA) |
| Codebook#2 Codeword | (NA) | | | | (NA) | | | | (NA) |
| Codebook#3,4 Index | 34 (=27*\|-1\|+ 9*\|0\|+3*\|-2\|+\|1\|) | | | | 66 (=27*\|2\|+9*\|-1\|+3*\|1\| + \|0\|) | | | | – |
| Codebook#3 Codeword | 10 bits | | | | 9 bits | | | | 19 bits |
| Codebook#4 Codeword | 8 bits | | | | 7 bits | | | | 15 bits (Smallest) |
| Codebook#5,6 Index | 31 (=9*\|-1\|+0+40) | | 23 (=9*\|-2\|+1+ 40) | | 21 (=9*\|2\|+\|-1\|+40) | | 49 (=9*\|1\|+0+40) | | – |
| Codebook#5 Codeword | 4 bits | | 8 bits | | 8 bits | | 4 bits | | 24 bits |
| Codebook#6 Codeword | 4 bits | | 8 bits | | 6 bits | | 4 bits | | 20 bits |
| Codebook#7,8 Index | 8 (=8*\|-1\|+\|0\|) | | 17 (=8*\|-2\|+\|1\|) | | 17 (=8*\|2\|+\|-1\|) | | 8 (=8*\|1\|+\|0\|) | | – |
| Codebook#7 Codeword | 3 bits | | 6 bits | | 6 bits | | 3 bits | | 18 bits |
| Codebook#8 Codeword | 4 bits | | 4 bits | | 4 bits | | 4 bits | | 16 bits |
| Codebook#9,10 Index | 13 (=13*\|-1\|+\|0\|) | | 27 (=13*\|-2\|+\|1\|) | | 27 (=13*\|2\|+\|-1\|) | | 13 (=13*\|1\|+\|0\|) | | – |
| Codebook#9 Codeword | 3 bits | | 6 bits | | 6 bits | | 3 bits | | 18 bits |
| Codebook#10 Codeword | 5 bits | | 4 bits | | 4 bits | | 5 bits | | 18 bits |
| Codebook#11 Index | (NA) | | (NA) | | (NA) | | (NA) | | (NA) |
| Codebook#11 Codeword | (NA) | | (NA) | | (NA) | | (NA) | | (NA) |

T1

FIG. 9A

HUFFMAN CODEBOOK #1

FIG. 9B

HUFFMAN CODEBOOK #2

FIG. 9C

HUFFMAN CODEBOOK #3

| index | length | codeword |
|---|---|---|
| ⋮ | ⋮ | ⋮ |
| 34 | 10 | 3ec |
| ⋮ | ⋮ | ⋮ |
| 66 | 9 | fea |
| ⋮ | ⋮ | ⋮ |

FIG. 9D

HUFFMAN CODEBOOK #4

| index | length | codeword |
|---|---|---|
| ⋮ | ⋮ | ⋮ |
| 34 | 8 | e8 |
| ⋮ | ⋮ | ⋮ |
| 66 | 7 | 6c |
| ⋮ | ⋮ | ⋮ |

FIG. 10A

HUFFMAN CODEBOOK #5

| index | length | codeword |
|---|---|---|
| ⋮ | ⋮ | ⋮ |
| 21 | 8 | e8 |
| ⋮ | ⋮ | ⋮ |
| 23 | 8 | ec |
| ⋮ | ⋮ | ⋮ |
| 31 | 4 | 8 |
| ⋮ | ⋮ | ⋮ |
| 49 | 4 | 9 |
| ⋮ | ⋮ | ⋮ |

FIG. 10B

HUFFMAN CODEBOOK #6

| index | length | codeword |
|---|---|---|
| ⋮ | ⋮ | ⋮ |
| 21 | 6 | 27 |
| ⋮ | ⋮ | ⋮ |
| 23 | 6 | 26 |
| ⋮ | ⋮ | ⋮ |
| 31 | 4 | 4 |
| ⋮ | ⋮ | ⋮ |
| 49 | 4 | 1 |
| ⋮ | ⋮ | ⋮ |

FIG. 11A

HUFFMAN CODEBOOK #7

| index | length | codeword |
|---|---|---|
| ⋮ | ⋮ | ⋮ |
| 8 | 3 | 4 |
| ⋮ | ⋮ | ⋮ |
| 17 | 6 | 34 |
| ⋮ | ⋮ | ⋮ |

FIG. 11B

HUFFMAN CODEBOOK #8

| index | length | codeword |
|---|---|---|
| ⋮ | ⋮ | ⋮ |
| 8 | 4 | 3 |
| ⋮ | ⋮ | ⋮ |
| 17 | 4 | 2 |
| ⋮ | ⋮ | ⋮ |

FIG. 12A

HUFFMAN CODEBOOK #9

| index | length | codeword |
|---|---|---|
| ⋮ | ⋮ | ⋮ |
| 13 | 3 | 4 |
| ⋮ | ⋮ | ⋮ |
| 27 | 6 | 34 |
| ⋮ | ⋮ | ⋮ |

FIG. 12B

HUFFMAN CODEBOOK #10

| index | length | codeword |
|---|---|---|
| ⋮ | ⋮ | ⋮ |
| 13 | 5 | 7 |
| ⋮ | ⋮ | ⋮ |
| 27 | 4 | 2 |
| ⋮ | ⋮ | ⋮ |

FIG. 12C

HUFFMAN CODEBOOK #11

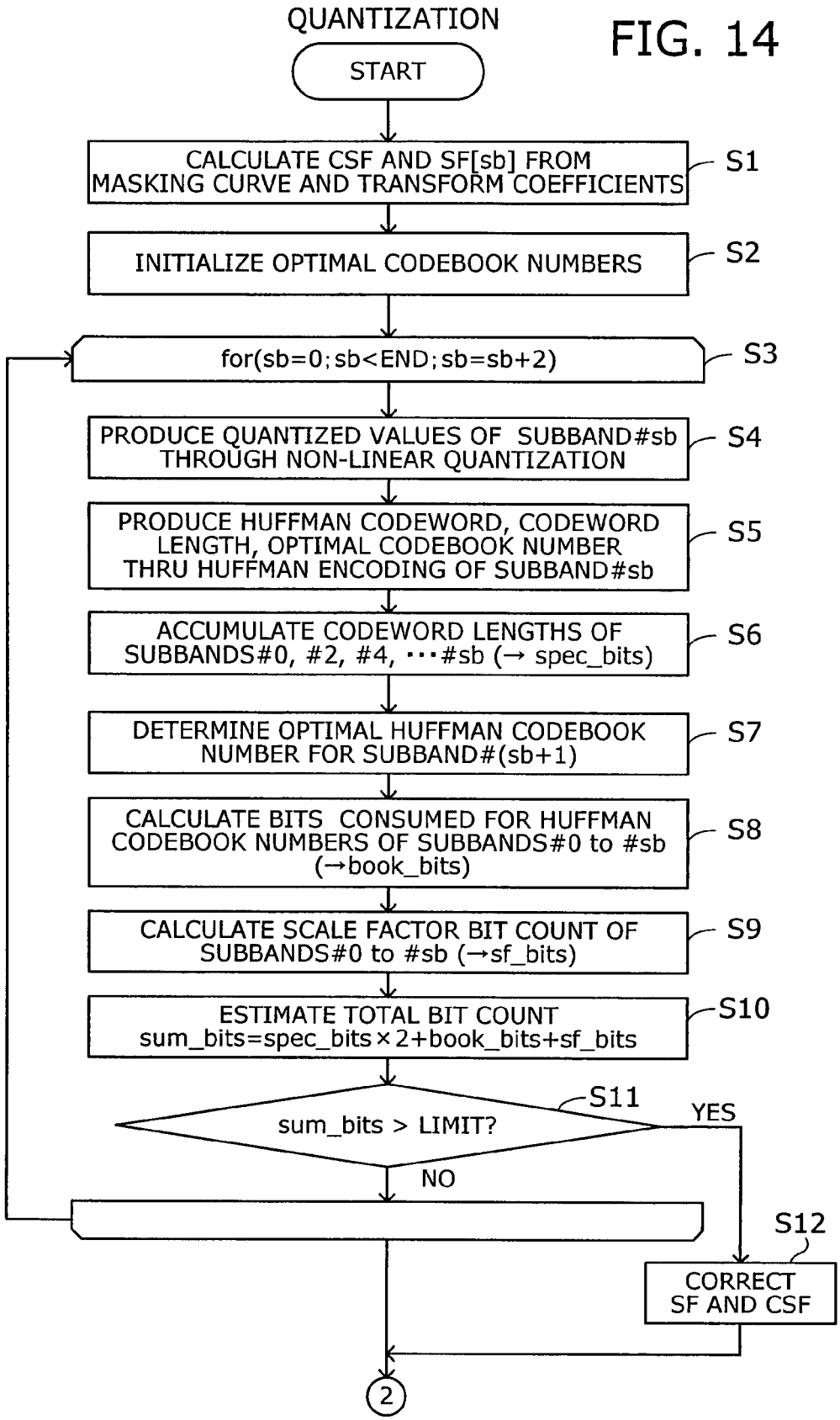
QUANTIZATION
FIG. 14
START
CALCULATE CSF AND SF[sb] FROM MASKING CURVE AND TRANSFORM COEFFICIENTS
S1
INITIALIZE OPTIMAL CODEBOOK NUMBERS
S2
for(sb=0;sb<END;sb=sb+2)
S3
PRODUCE QUANTIZED VALUES OF SUBBAND#sb THROUGH NON-LINEAR QUANTIZATION
S4
PRODUCE HUFFMAN CODEWORD, CODEWORD LENGTH, OPTIMAL CODEBOOK NUMBER THRU HUFFMAN ENCODING OF SUBBAND#sb
S5
ACCUMULATE CODEWORD LENGTHS OF SUBBANDS#0, #2, #4, ···#sb (→ spec_bits)
S6
DETERMINE OPTIMAL HUFFMAN CODEBOOK NUMBER FOR SUBBAND#(sb+1)
S7
CALCULATE BITS CONSUMED FOR HUFFMAN CODEBOOK NUMBERS OF SUBBANDS#0 to #sb (→book_bits)
S8
CALCULATE SCALE FACTOR BIT COUNT OF SUBBANDS#0 to #sb (→sf_bits)
S9
ESTIMATE TOTAL BIT COUNT sum_bits=spec_bits×2+book_bits+sf_bits
S10
sum_bits > LIMIT?
S11
YES
NO
S12
CORRECT SF AND CSF
2

CODEBOOK NUMBER RUN LENGTH INFORMATION

AUDIO CODING DEVICE WITH TWO-STAGE QUANTIZATION MECHANISM

CROSS-REFERENCE TO RELATED APPLICATIONS

This application is based upon and claims the benefits of priority from the prior Japanese Patent Application No. 2006-262022, filed on Sep. 27, 2006, the entire contents of which are incorporated herein by reference.

BACKGROUND OF THE INVENTION

1. Field of the Invention

The present invention relates to audio coding devices, and more particularly to an audio coding device that encodes speech signals into MPEG Audio Layer-3 (MP3), MPEG2 Advanced Audio Codec (MPEG2-AAC), or other like form.

2. Description of the Related Art

Enhanced coding techniques have been developed and used to store or transmit digital audio signals in highly compressed form. Such audio compression algorithms are standardized as, for example, the Moving Picture Expert Group (MPEG) specifications, which include AAC, or Advanced Audio Codec. AAC, recommended by the International Organization for Standardization (ISO) and International Electrotechnical Commission (IEC) as ISO/IEC 13818-7, achieves both high audio qualities and high compression ratios. AAC is used in various areas, including online distribution of music via mobile phone networks and digital television broadcasting via satellite and terrestrial channels.

The coding algorithm of AAC includes iterative processing operations called inner and outer loops to quantize data within a given bit rate budget. The inner loop quantizes audio data in such a way that a specified bit rate constraint will be satisfied. The outer loop adjusts the common scale factor (CSF) and scale factors (SF) of individual subbands so as to satisfy some conditions for restricting quantization noise within a masking curve, where the term "quantization noise" refers to the difference between dequantized values and original values.

As an example of a conventional audio coding technology, the Japanese Patent Application Publication No. 2002-196792 proposes a technique to determine which frequency bands to encode in an adaptive manner (see, for example, paragraphs Nos. 0022 to 0048 and FIG. 1 of the publication). This technique first determines initial values of a plurality of scale factor bands and thresholds. Out of those scale factor bands, the proposed algorithm selects a maximum scale factor band for determining frequency bands to be coded, based on the psychoacoustic model and the result of a frequency spectrum analysis performed on given input signals.

ISO/IEC AAC standard requires both the above-described inner and outer loops to be executed until they satisfy prescribed conditions, meaning that the quantization processing may be repeated endlessly in those loops.

Conventional algorithms repeat quantization operations until an optimal set of quantization parameters (CSF and SF) is obtained. The problem is slow convergence of iterations and degraded sound quality due to fluctuations in frequency ranges to be encoded.

SUMMARY OF THE INVENTION

In view of the foregoing, it is an object of the present invention to provide an audio coding device that quickly optimizes quantization parameters for fast convergence of the iteration so as to achieve improvement in sound quality.

To accomplish the above object, the present invention provides an apparatus for coding audio signals. This apparatus has the following elements: a quantizer, a quantized bit counter, a bit count estimator, a comparator, and a parameter updater. The quantizer quantizes spectrum signals in each subband to produce quantized values. The quantized bit counter calculates at least a codeword length representing the number of bits of a Huffman codeword corresponding to the quantized values and accumulates the calculated codeword length into a cumulative codeword length. The bit count estimator calculates a total bit count estimate representing how many bits will be produced as result of quantization, based on the cumulative codeword length and other bit counts related to the quantization. The comparator determines whether the total bit count estimate falls within a bit count limit. The parameter updater updates quantization parameters including a common scale factor and individual scale factors if the total bit count estimate exceeds the bit count limit. The above apparatus executes quantization in first and second stages. In the first stage, the quantizer quantizes every nth subband, and the quantized bit counter accumulates codeword lengths corresponding to the quantized values that the quantizer has produced for every nth subband. The bit count estimator calculates the total bit count estimate by adding up n times the cumulative codeword length and other bit counts.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 8 shows a table containing indexes and Huffman codeword lengths corresponding to quantized values.

FIGS. 9A-9D, 10A-10B, 11A-11B, and 12A-12C show Huffman codebook table values.

FIGS. 14 and 15 show a flowchart describing how the audio coding device operates.

DESCRIPTION OF THE PREFERRED EMBODIMENTS

Figure 1:
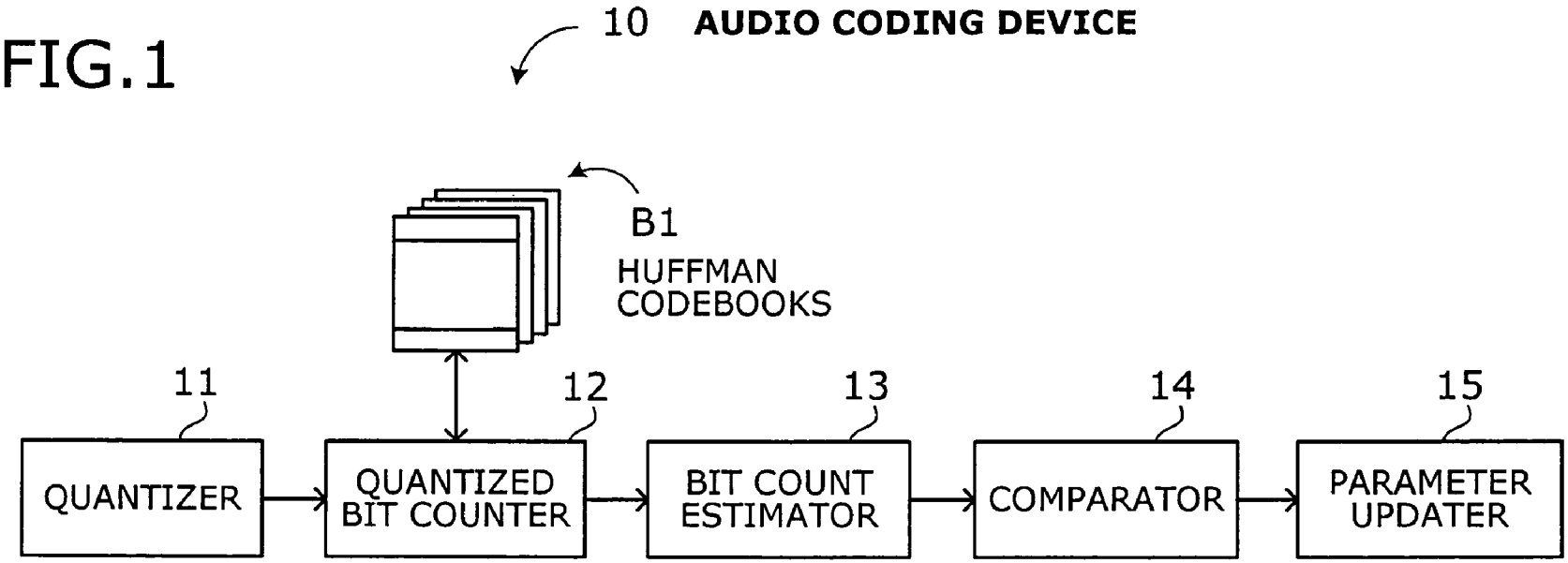
FIG. 1 is a conceptual view of an audio coding device according to an embodiment of the present invention.

Preferred embodiments of the present invention will be described below with reference to the accompanying drawings, wherein like reference numerals refer to like elements throughout.

FIG. 1 is a conceptual view of an audio coding device according to an embodiment of the present invention. For speech coding purposes, this audio coding device 10 includes a quantizer 11, a quantized bit counter 12, a bit count estimator 13, a comparator 14, a parameter updater 15, and Huffman codebooks B1. The audio coding device 10 may be applied to, for example, audio video equipment such as DVD recorders and digital movie cameras, as well as to devices producing data for solid-state audio players.

The quantizer 11 quantizes spectrum signals in each subband to produce quantized values. The quantized bit counter 12 calculates at least a codeword length representing the number of bits of a Huffman codeword corresponding to the quantized values. The quantized bit counter 12 accumulates the calculated codeword length into a cumulative codeword length.

The cumulative codeword length will be a part of total bit count, i.e., the total number of data bits produced as the outcome of the quantization process. Other part of this total bit count includes a codebook number bit count and a scale factor bit count. The codebook number bit count represents how many bits are necessary to convey optimal Huffman codebook numbers of subbands. The Huffman coding process selects an optimal codebook out of a plurality of Huffman codebooks B1, where ISO/IEC 13818-7 defines eleven codebooks. The scale factor bit count represents how many bits are necessary to convey scale factors of subbands.

The bit count estimator 13 calculates a total bit count estimate representing how many bits will be produced as result of quantization, based on the cumulative codeword length, codebook number bit count, and scale factor bit count. The comparator 14 determines whether the total bit count estimate falls within a bit count limit. The parameter updater 15 updates the quantization parameters including a common scale factor and individual scale factors when the total bit count estimate exceeds the bit count limit.

The quantization process is performed in two stages. In the first stage, the quantizer 11 quantizes not each every subband, but every nth subband, i.e., one out of every n subbands. Based on the quantization result of each sampled subband, the quantized bit counter 12 counts the number of Huffman codeword bits and accumulates it into the cumulative codeword length. The bit count estimator 13 multiplies the resulting cumulative codeword length by n and sums up the resulting product, the codebook number bit count, and the scale factor bit count, thus outputting a total bit count estimate. More detailed structure and operation of the proposed audio coding device 10 will be described later.

Audio Compression Techniques

Before providing details of the audio coding device 10, this section describes the basic concept of audio compression techniques related to the present invention, in comparison with a quantization process of conventional audio encoders, to clarify the problems that the present invention intends to solve.

Conventional AAC encoders subjects each frame of pulse code modulation (PCM) signals to a modified discrete cosine transform (MDCT). MDCT is a spatial transform algorithm that translates power of PCM signals from time domain to spatial (frequency) domain. The resultant MDCT transform coefficients (or simply "transform coefficients") are directed to a quantization process adapted to the characteristics of the human auditory system. The quantization process is followed by Huffman encoding to yield an output bitstream for the purpose of distribution over a transmission line. Here the term "frame" refers to one unit of sampled signals to be encoded together. According to the AAC standard, one frame consists of 1024 MDCT transform coefficients obtained from 2048 PCM samples.

Figure 2:
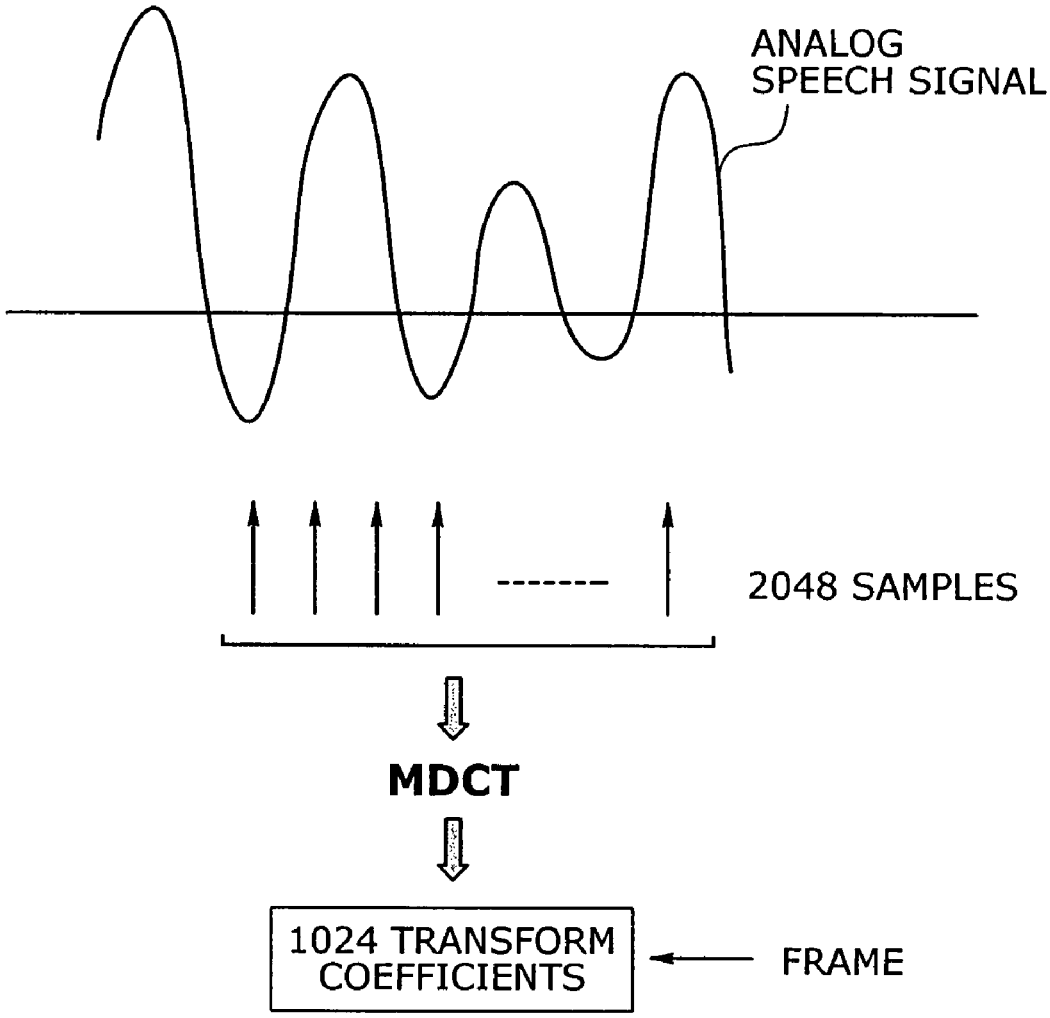
FIG. 2 shows the concept of frames.

FIG. 2 shows the concept of frames. As FIG. 2 illustrates, a segment of a given analog audio signal is first digitized into 2048 PCM samples, which are then subjected to MDCT. The resulting 1024 transform coefficients are referred to as a frame.

Figure 3:
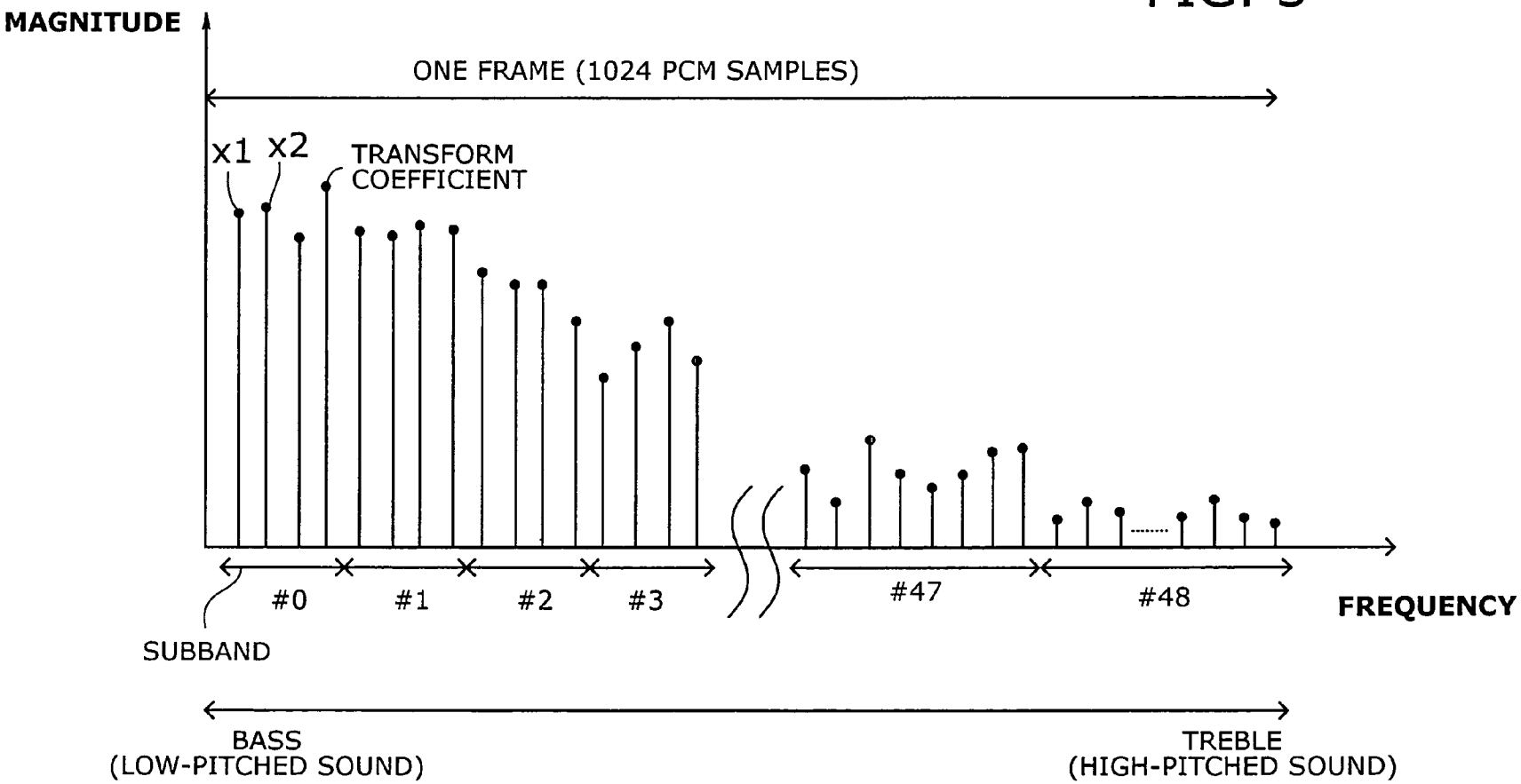
FIG. 3 depicts the concept of transform coefficients and subbands.

FIG. 3 depicts the concept of transform coefficients and subbands, where the vertical axis represents the magnitude of transform coefficients, and the horizontal axis represents frequency. The 1024 transform coefficients are divided into 49 groups of frequency ranges, or subbands. Those subbands are numbered #0 to #48. ISO/IEC 13818-7 requires that the number of transform coefficients contained in each subband be a multiple of four. Actually the number of transform coefficients in a subband varies according to the characteristics of the human hearing system. Specifically, more coefficients are contained in higher-frequency subbands. While every transform coefficient appears to be positive in the example of FIG. 3, this is because FIG. 3 shows their magnitude, or the absolute values. Actual transform coefficients may take either positive or negative values.

As can be seen from FIG. 3, lower subbands contain fewer transform coefficients, whereas higher subbands contain more transform coefficients. In other words, lower subbands are narrow, whereas higher subbands are wide. This uneven division of subbands is based on the fact that the human perception of sound tends to be sensitive to frequency differences in the bass range (or lower frequency bands), as with the transform coefficients x1 and x2 illustrated in FIG. 3, but not in the treble range (or higher frequency bands). In other words, the human auditory system has a finer frequency resolution in low frequency ranges, but it cannot distinguish two high-pitch sounds very well. For this reason, low frequency ranges are divided into narrow subbands, while high frequency ranges are divided into wide subbands, according to the sensitivity to frequency differences.

Figure 4:
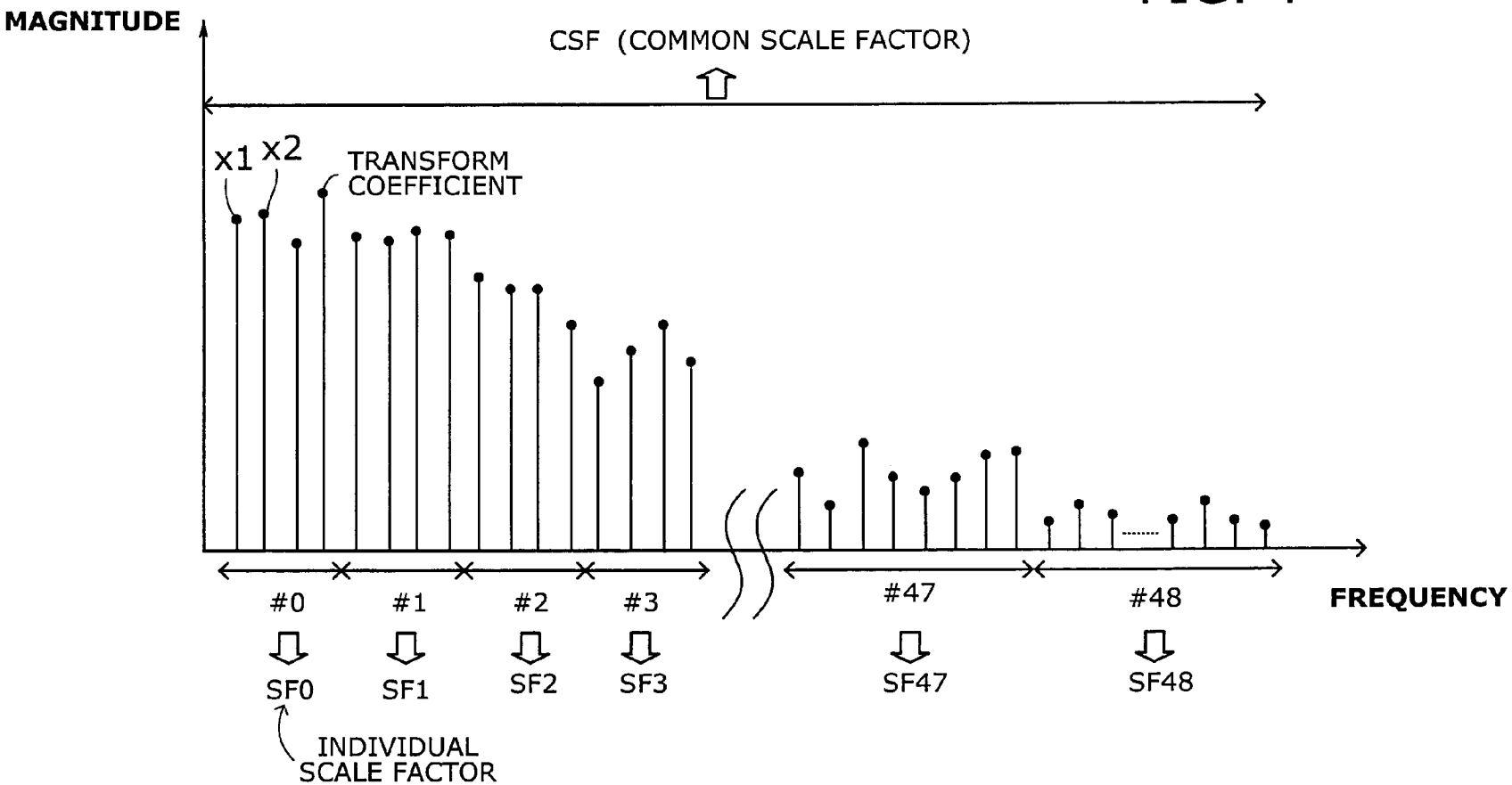
FIG. 4 shows the association between a common scale factor and individual scale factors within a frame.

FIG. 4 shows the association between a common scale factor CSF and individual scale factors SF0 to SF48 within a frame, which are corresponding to the subbands #0 to #48 shown in FIG. 3. Common scale factor CSF applies to the entire set of subbands #0 to #48. Forty-nine scale factors SF0 to SF48, on the other hand, apply to individual subbands #0 to #48. All the common and individual scale factors take integer values.

Quantization step size q, common scale factor, and scale factor are interrelated as follows:

$$q = \text{scale factor} - \text{common scale factor} \quad (1)$$

where "scale factor" on the right side refers to a scale factor of a particular subband. Equation (1) means that the common scale factor is an offset of quantization step sizes for the entire frame.

Let sb be a subband number (sb=0, 1, . . . 48). Then the quantization step size q[sb] for subband #sb is given as: q[sb]=SF[sb]−CSF.

Figure 5:
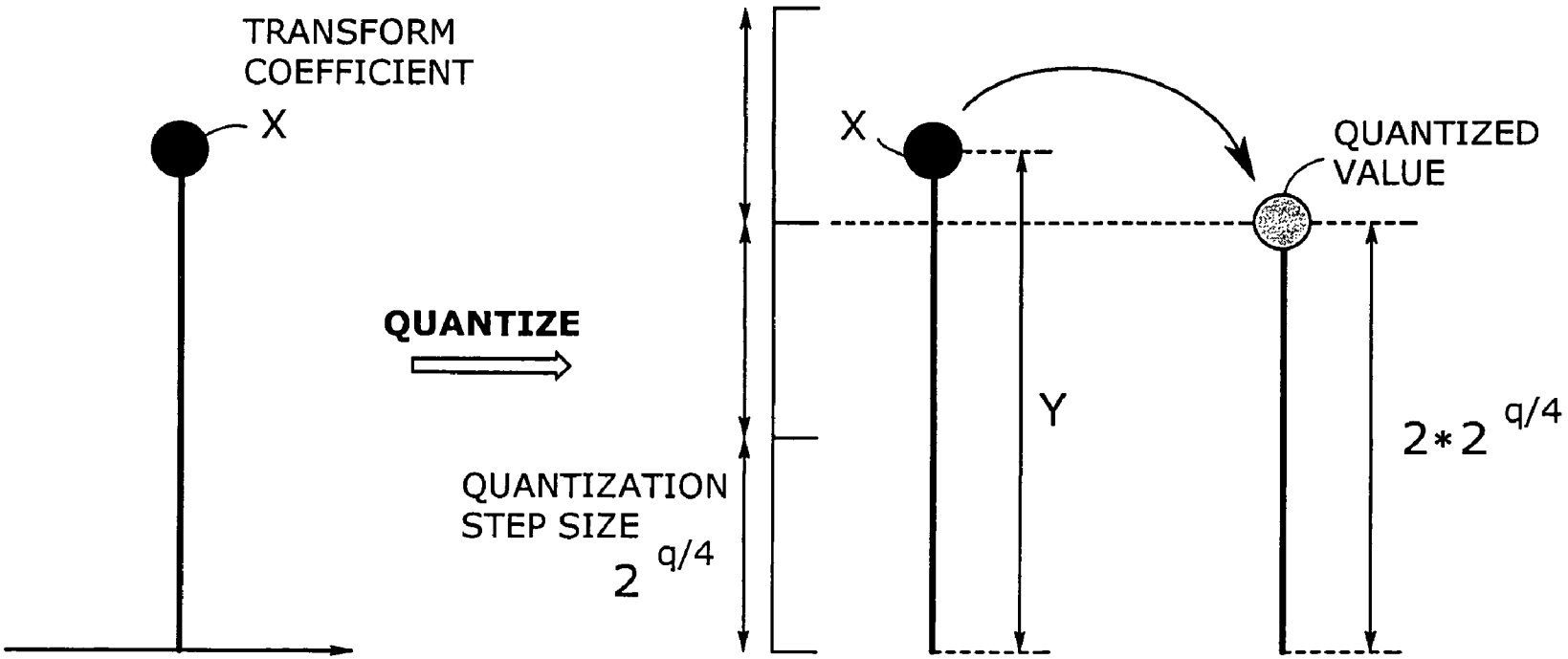
FIG. 5 shows the concept of quantization.

FIG. 5 shows the concept of quantization. Let Y represent the magnitude of a transform coefficient X. Quantizing the transform coefficient X simply means truncating the quotient of Y by quantization step size q. FIG. 5 depicts this process of dividing the magnitude Y by a quantization step size $2^{q/4}$ and discarding the least significant digits right of the decimal point. As a result, the given transform coefficient X is quantized into $2*2^{q/4}$ Think of a simple example where the division of Y by a step size of 10 results in a quotient of 9.6. In this case, the quantizer discards the fraction of Y/10, thus yielding 9 as a quantized value of Y.

As can be seen from FIG. 5, how to select an appropriate quantization step size will be a key issue for improving the quality of encoded audio signals with minimized quantization error. As mentioned earlier, the quantization step size is a function of common and individual scale factors. That is, the most critical point for audio quality in quantization and coding processes is how to select an optimal common scale factor for a given frame and an optimal set of individual scale factors for its subbands. Once both kinds of scale factors are optimized, the quantization step size of each subband can be calculated from formula (1). Then the transform coefficients in each subband #sb are quantized by dividing them by the corresponding step size. Then with a Huffman codebook, each quantized value is encoded into a Huffman code for transmission purposes. The problem here, however, is that the method specified in the related ISO/IEC standards requires a considerable amount of computation to yield optimal common and individual scale factors. The reason will be described in the subsequent paragraphs.

Figure 6:
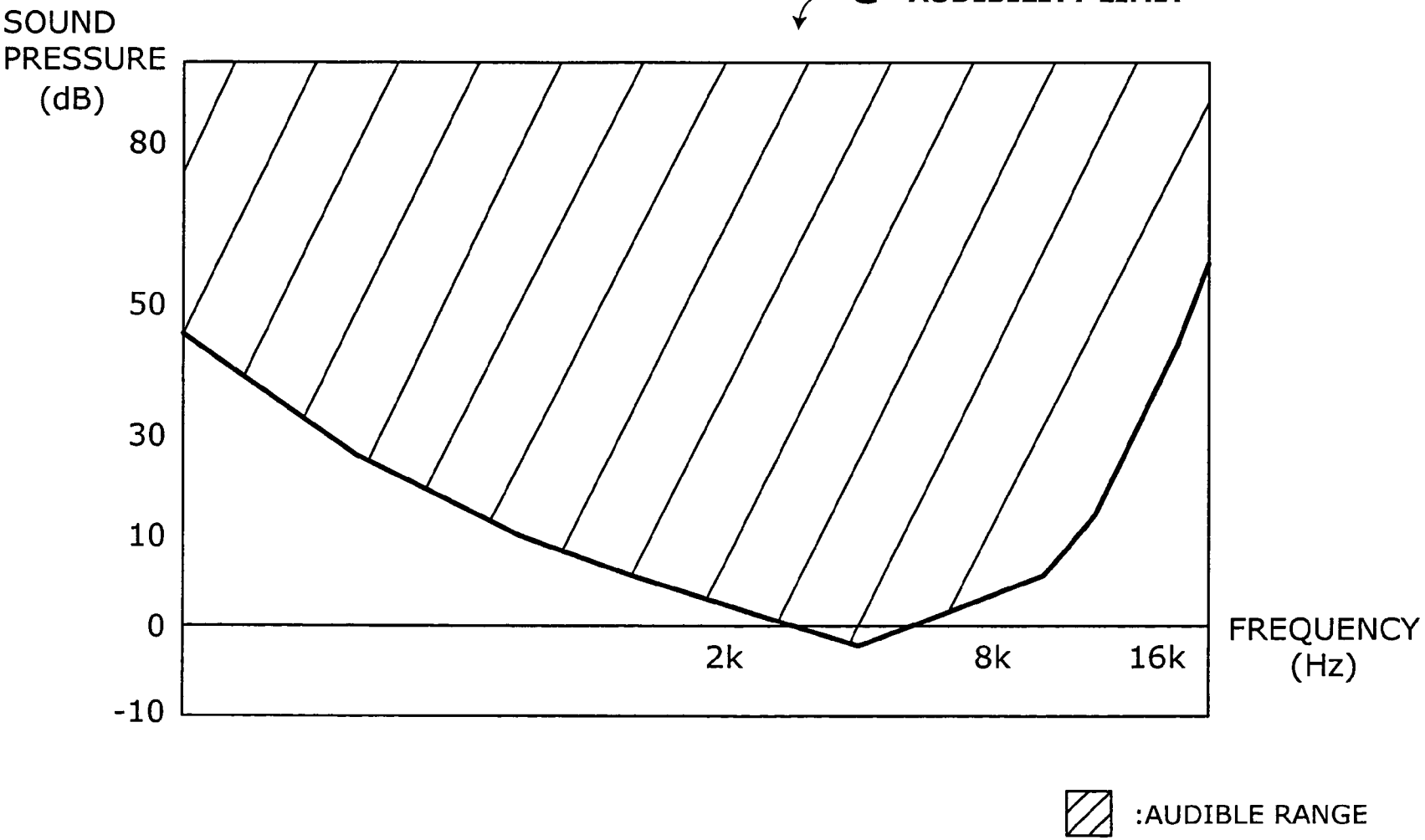
FIG. 6 is a graph showing a typical audibility limit.

Common and individual scale factors are determined in accordance with masking power thresholds, a set of parameters representing one of the characteristics of the human auditory system. The masking power threshold refers to a minimum sound pressure that humans can perceive. FIG. 6 is a graph G showing a typical audibility limit, where the vertical axis represents sound pressure (dB) and the horizontal axis represents frequency (Hz). The sensitivity of ears is not constant in the audible range (20 Hz to 20,000 Hz) of humans, but heavily depends on frequencies. More specifically, the peak sensitivity is found at frequencies of 3 kHz to 4 kHz, with sharp drops in both low-frequency and high-frequency regions. This means that low- or high-frequency sound components would not be heard unless the volume is increased to a sufficient level.

The hatched part of this graph G indicates the audible range. The human ear needs a larger sound pressure (volume) in both high and low frequencies, whereas the sound in the range between 3 kHz and 4 kHz can be heard even if its pressure is small. Based on this graph G of audibility limits, a series of masking power thresholds are determined with the fast Fourier transform (FFT) technique. The masking power threshold at a frequency f gives a minimum sound level L that human can perceive.

Figure 7:
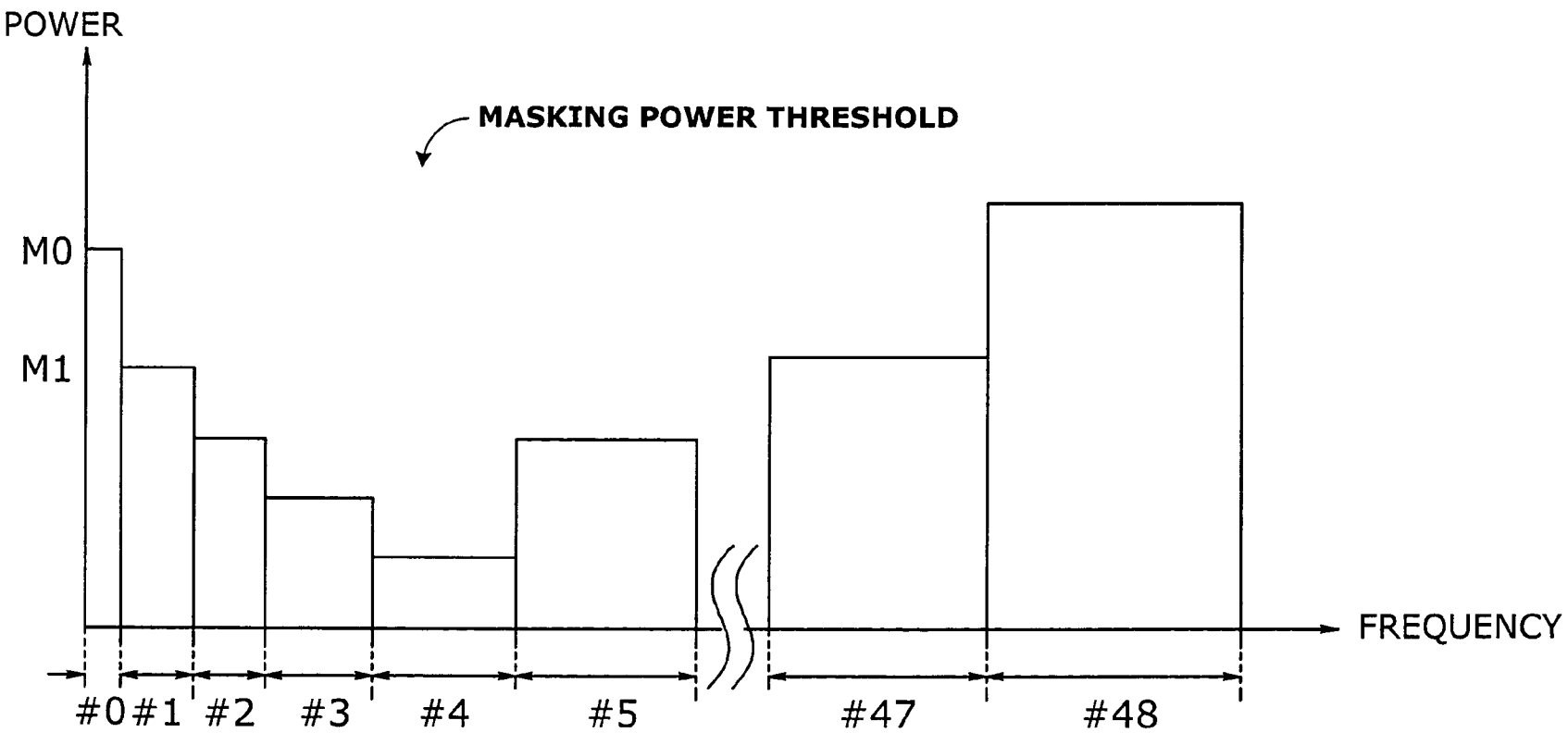
FIG. 7 shows an example of masking power thresholds.

FIG. 7 shows an example of masking power thresholds, the vertical axis represents threshold power, and the horizontal axis represents frequency. The range of frequency components of a single frame is divided into subbands #0 to #48, each having a corresponding masking power threshold. Specifically, a masking power threshold M0 is set to the lowest subband #0, meaning that it is hard to hear a signal (sound) in that subband #0 if its power level is M0 or smaller. Audio signal processors are therefore allowed to regard the signals below this threshold M0 as noise. Accordingly, the quantizer has to be designed to process every subband in such a way that the quantization error power of each subband will not exceed the corresponding masking power threshold. Take subband #0, for example. The individual and common scale factors are to be determined such that the quantization error power in subband #0 will be smaller than the masking power threshold M0 of that subband.

Located next to subband #0 with a masking power threshold of M0 is the second lowest subband #1 with a masking power threshold of M1, where M1 is smaller than M0. As can be seen, the magnitude of maximum permissible noise is different from subband to subband. In the present example, the first subband #0 is more noise-tolerant than the second subband #1, meaning that subband #0 allows larger quantization errors than subband #1 does. The quantizer is therefore allowed to use a coarser step size when quantizing subband #0. Subband #1, on the other hand, is more noise-sensitive than subband #0 and thus requires a finer step size so as to reduce quantization error.

Of all subbands in the frame shown in FIG. 7, the fifth subband #4 has the smallest masking power threshold, and the highest subband #48 has the largest. Accordingly, subband #4 should be assigned a smallest quantization step size to minimize quantization error and its consequent audible distortion. On the other hand, subband #48 is the most noise-tolerant subband, thus accepting the coarsest quantization in the frame.

The quantizer has to take the above-described masking power thresholds into consideration when it determines each subband-specific scale factor and a common scale factor for a given frame. The restriction of output bitrates is another issue that needs consideration. Since the bitrate budget of a coded bit stream is specified beforehand (e.g., 128 kbps), the number of coded bits produced from every given sound frame must be within that budget.

AAC has a temporary storage mechanism, called "bit reservoir," to allow a less complex frame to give its unused bandwidth to a more complex frame that needs a higher bitrate than the defined nominal bitrate. The number of coded bits is calculated from a specified bitrate, perceptual entropy in the acoustic model, and the amount of bits in a bit reservoir. The perceptual entropy is derived from a frequency spectrum obtained through FFT of a source audio signal frame. In short, the perceptual entropy represents the total number of bits required to quantize a given frame without producing as large noise as listeners can notice. More specifically, wide-spectrum signals such as an impulse or white noise tend to have a large perceptual entropy, and more bits are therefore required to encode them correctly.

As can be seen from the above discussion, the encoder has to determine two kinds of scale factors, CSF and SF, satisfying the limit of masking power thresholds, under the restriction of available bandwidth for coded bits. The conventional ISO-standard technique implements this calculation by repeating quantization and dequantization while changing the values of CSF and SF step by step. This conventional calculation process begins with setting initial values of individual and common scale factors. With those initial scale factors, the process attempts to quantize given transform coefficients. The quantized coefficients are then dequantized in order to calculate their respective quantization errors (i.e., the difference between each original transform coefficient and its dequantized version). Subsequently the process compares the maximum quantization error in a subband with the corresponding masking power threshold. If the former is greater than the latter, the process increases the current scale factor and repeats the same steps of quantization, dequantization, and noise power evaluation with that new scale factor. If the maximum quantization error is smaller than the threshold, then the process advances to the next subband.

Finally the quantization error in every subband falls below its corresponding masking power threshold, meaning that all scale factors have been calculated. The process now passes the quantized values to a Huffman encoder to reduce their data size. It is then determined whether the amount of the resultant coded bits does not exceed the amount allowed by the specified bitrate. The process will be finished if the resultant amount is smaller than the allowed amount. If the resultant amount exceeds the allowed amount, then the process must return to the first step of the above-described loop after incrementing the common scale factor by one. With this new common scale factor and re-initialized individual scale factors, the process executes another cycle of quantization, dequantization, and evaluation of quantization errors and masking power thresholds.

As can be seen from the above process flow, the conventional encoder makes exhaustive calculation to seek an optimal set of quantization step sizes (or common and individual scale factors). That is, the encoder repeats the same process of quantization, dequantization, and encoding for each transform coefficient until a specified requirement is satisfied. The conventional algorithm has a drawback in its efficiency since it could fail to converge and fall into an endless loop, besides requiring an extremely large amount of computation. To solve this problem, the present invention provides an audio coding device that quickly optimizes quantization parameters (common and individual scale factors) for fast convergence of the iteration so as to achieve improvement in sound quality.

Optimal Huffman Codebook

This section gives some details of a process of selecting an optimal Huffman codebook. Quantized values are coded into a bitstream before they are sent out over a transmission channel. Huffman coding algorithm is used in most cases for this purpose, which assigns shorter codes to frequently occurring values and longer codes to less frequently occurring values. AAC defines eleven Huffman codebooks numbered "1" to "11" to allow the encoder to choose an optimal codebook for each individual subband. Huffman codebook number #0 is assigned to subbands that have not been quantized. The decoding end does not decode those subbands having a codebook number of zero.

Think of a transform coefficient X for a spectrum signal belonging to subband #sb. The following formula (2) gives nonlinear quantization of X and yields a quantized value Q.

$$Q=|X|*2*\mathrm{sign}(X) \tag{2}$$

$$\mathrm{GAIN}=(3/16)*(\mathrm{SF}[sb]-\mathrm{CSF})+\mathrm{MAGIC_NUMBER}$$

where SF[sb] represents a scale factor for subband #sb, CSF a common scale factor, and sign(X) the sign bit of X. The sign bit sign(X) takes a value of +1 when X≧0 and −1 when X<0. MAGIC_NUMBER is set to 0.4054 according to ISO/IEC 13818-7. Every transform coefficient within a subband #sb is subjected to this formula (2). The resulting quantized values Q are used to select an optimal Huffman codebook for that subband #sb. The quantized values Q are then Huffman-coded using the selected codebook.

The following steps (A) to (E) will select an optimal Huffman codebook for subband #sb:

(A) Formula (2) is applied to m transform coefficients of subband #sb. Then, out of the resulting m quantized values Q[m], the largest in the absolute value is extracted as MAX_Q.

(B) Huffman codebooks corresponding to MAX_Q are selected as candidates. Note that this selection may yield two or more Huffman codebooks. More specifically, the following list shows which codebooks are selected depending on MAX_Q.

Huffman codebooks #1 and 2 for MAX_Q<2
Huffman codebooks #3 and 4 for MAX_Q<3
Huffman codebooks #5 and 6 for MAX_Q<5
Huffman codebooks #7 and 8 for MAX_Q<8
Huffman codebooks #9 and 10 for MAX_Q<13
Huffman codebook #11 for MAX_Q>=13

In the case of MAX_Q=2, for example, eight Huffman codebooks #3 to #10 are selected. In the case of MAX_Q=6, four Huffman codebooks #7 to #10 are selected. That is, the smaller the value of MAX_Q is, the more candidate codebooks are selected, thus increasing the possibility of finding shorter Huffman code words.

(C) An index for each selected Huffman codebook is calculated by multiplexing quantized values Q[m]. The multiplexing method may differ from codebook to codebook. Specifically, the following formulas (3) to (7) show how the index is calculated.

For Huffman codebooks #1 and #2:

$$\mathrm{index}=3^3\times Q[i]+3^2\times Q[i+1]+3^1\times Q[i+2]+3^0\times Q[i+3]+40 \tag{3}$$

For Huffman codebooks #3 and #4:

$$\mathrm{index}=3^3\times|Q[i]|+3^2\times|Q[i+1]|+3^1\times|Q[i+2]|+3^0\times|Q[i+3]| \tag{4}$$

For Huffman codebooks #5 and #6:

$$\mathrm{index}=9\times Q[i]+Q[i+1]+40 \tag{5}$$

For Huffman codebooks #7 and #8:

$$\mathrm{index}=8\times|Q[i]|+|Q[i+1] \tag{6}$$

For Huffman codebooks #9 and #10:

$$\mathrm{index}=13\times|Q[i]|+|Q[i+1] \tag{7}$$

(D) The number of codeword bits is calculated from the index of each Huffman codebook.

(E) A Huffman codebook giving the smallest number of bits is selected as an optimal Huffman codebook.

The above-described steps of codebook selection will now be described with reference to a specific example. Suppose now that the subband #sb of interest has eight transform coefficients and that the foregoing formula (2) has produced quantized values of Q[1]=−1, Q[1]=0, Q[2]=−2, Q[3]=1, Q[4]=+2, Q[5]=−1, Q[6]=1, and Q[7]=0. The maximum quantized value in this case is MAX_Q=2. The list of selection criteria discussed in (B) is used to nominate Huffman codebooks #3 to #10.

FIG. 8 shows a table containing Huffman codeword lengths and indexes corresponding to quantized values Q[O] to Q[7]. FIGS. 9A-9D, 10A-10B, 11A-1B, and 12A-12C show some specific values of Huffman codebooks relevant to the table of FIG. 8, which are extracted from Huffman codebooks defined by ISO/IEC 13818-7.

Referring to the section T1 of the table of FIG. 8, the calculation result of formula (4) for Huffman codebooks #3 and #4 is shown. Specifically, formula (4) is applied to two groups of quantized values, first to Q[0] to Q[3] and then to Q[4] to Q[7]. For the first group, the index is calculated as:

$$27\times|-1+9\times|0+3\times|-2|+|1|=34$$

For the second group, the index is calculated as:

$$27\times|2|+9\times|-1|+3\times|1|+|0|=66$$

Huffman codebook #3 shown in FIG. 9C is now looked up with the index of 34 for Q[0] to Q[3]), which results in a codeword length of 10. Likewise, the same codebook #3 is looked up with the index of 66 for Q[4] to Q[7], which results in a codeword length of 9. The total codeword length is therefore 19 bits.

In a similar way, Huffman codebook #4 shown in FIG. 9D is looked up with the index of 34 for Q[0] to Q[3], which results in a codeword length of 8. Likewise, the same codebook #4 is looked up with the index of 66 for Q[4] to Q[7], which results in a codeword length of 7. The total codeword length in this case is 15 bits.

Other pairs of Huffman codebooks (#5, #6), (#7, #8), and (#9, #10) are also consulted in the same way as in the case of (#3, #4). Details are therefore omitted here. It should be noted, however, that formulas (5), (6), and (7) corresponding respectively to Huffman codebook pairs (#5, #6), (#7, #8), and (#9, #10) require the eight quantized values to be divided into the following four groups: (Q[0], Q[1]), (Q[2], Q[3]), (Q[4], Q[5]), and (Q[6], Q[7]).

The rightmost column of FIG. 8 shows total codeword lengths obtained as a result of the above-described calculation. This column indicates that Huffman codebook #4 gives the shortest length, 15 bits, of all codebooks. Accordingly, Huffman codebook #4 is selected as being optimal for coding of subband #sb.

Referring again to Huffman codebook #4 of FIG. 9D, the codeword field gives a value of "e8" for index=34 and "6*c*" for index=66. These two codewords "e8" and "6*c*" represent the first group of quantized values Q[0] to Q[3] and the second group of quantized values Q[4] to Q[7], respectively. That is, the first four quantized values Q[0] to Q[3] in subband #sb are Huffman-coded collectively into "e8," and the remaining quantized values Q[4] to Q[7] in the same subband #sb are Huffman-coded into "6*c*." In this way, the audio coding device selects an optimal Huffman codebook and encodes data using the selected codebook, thereby producing a bitstream of Huffman codewords for delivery to the decoding end.

Audio Coding Device

Figure 13:
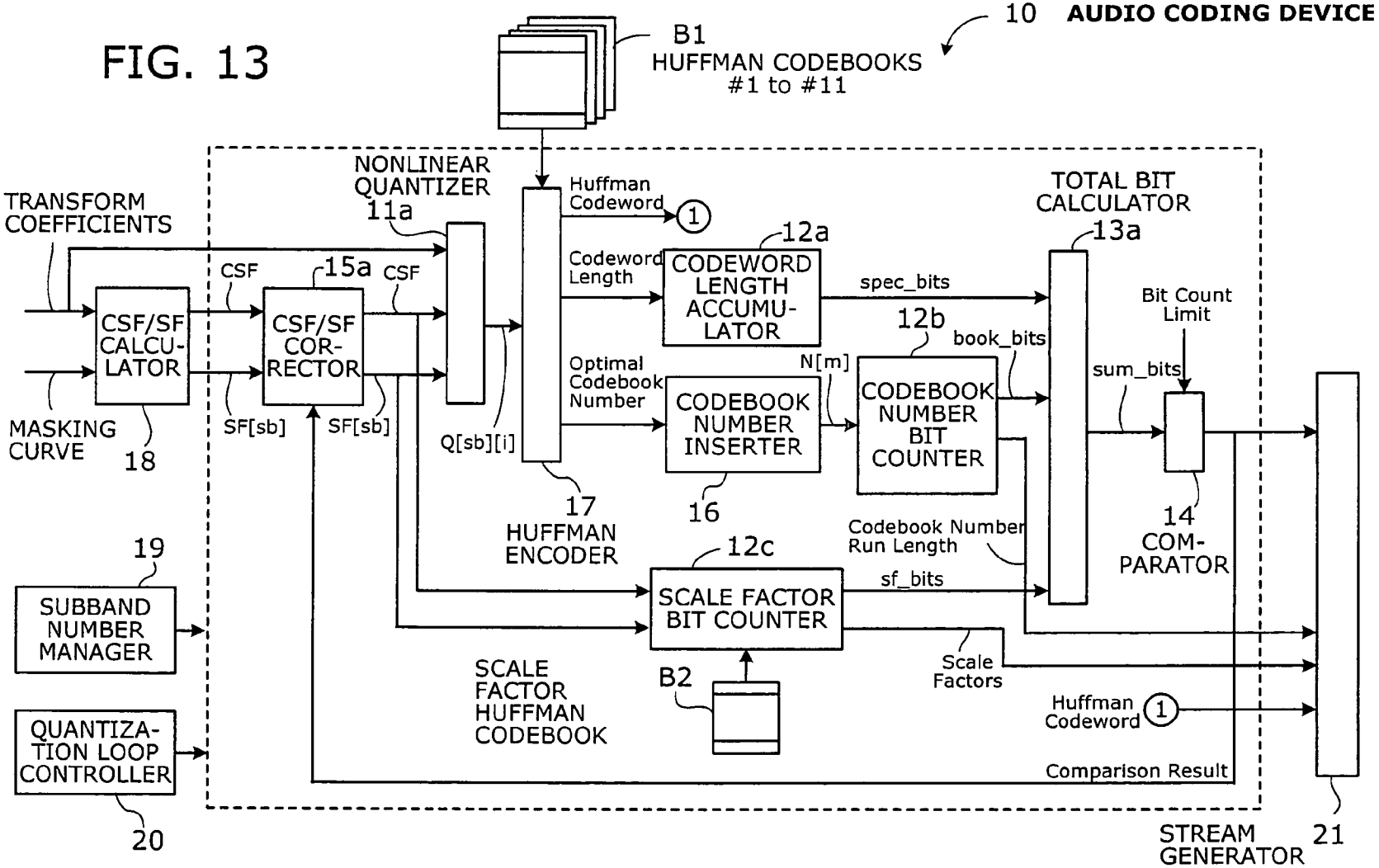
FIG. 13 is a block diagram of an audio coding device.

This section describes in greater detail the structure and operation of the audio coding device 10. Referring first to the block diagram of FIG. 13, the audio coding device 10 is formed from the following components: a nonlinear quantizer 11*a*, a codeword length accumulator 12*a*, a codebook number bit counter 12*b*, a scale factor bit counter 12*c*, a total bit calculator 13*a*, a comparator 14, a CSF/SF corrector 15*a*, a codebook number inserter 16, a Huffman encoder 17, a CSF/SF calculator 18, a subband number manager 19, a quantization loop controller 20, a stream generator 21, Huffman codebooks B1, and a scale factor codebook B2.

The quantizer 11 described earlier in FIG. 1 is now implemented in this audio coding device 10 as a nonlinear quantizer 11*a*. The quantized bit counter 12 in FIG. 1 is divided into a codeword length accumulator 12*a*, a codebook number bit counter 12*b*, and a scale factor bit counter 12*c* in FIG. 13. The bit count estimator 13 in FIG. 1 is implemented as a total bit calculator 13*a*, and the parameter updater 15 as a CSF/SF corrector 15*a* in FIG. 13.

Figure 15:
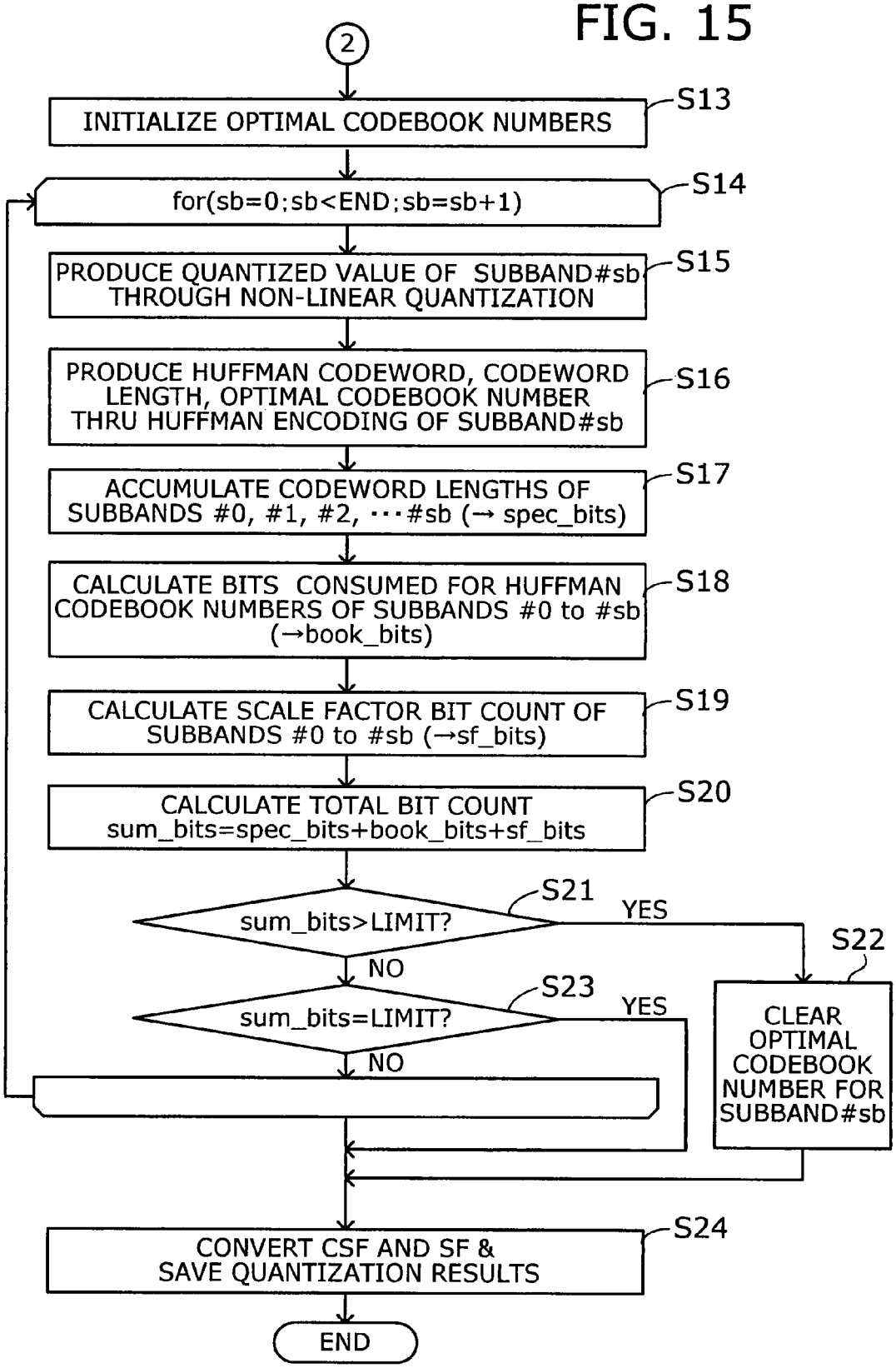

Referring now to the flowchart of FIGS. 14 and 15, the following will describes the operation of each component of the audio coding device 10.

(S1) With given transform coefficients and masking curve, the CSF/SF calculator 18 calculates a common scale factor CSF and subband-specific scale factors SF[sb]. CSF and SF[sb] are key parameters for quantization.

(S2) The Huffman encoder 17 initializes optimal codebook numbers.

(S3) The quantization loop controller 20 begins a first stage of quantization (as opposed to another stage that will follow). More specifically, in the first stage of quantization, the subband number manager 19 moves its focus to every second subband in the first stage. In other words, the subband number manager 19 increments the subband number #sb by two (e.g., #0, #2, #4, . . . ).

(S4) The nonlinear quantizer 11*a* subjects transform coefficients of subband #sb (#0, #2, #4, . . . ) to a nonlinear quantization process. Specifically, with formula (2), the nonlinear quantizer 11*a* calculates quantized values Q[sb][i] of transform coefficients X using CSF and SF[sb] determined at step S1. Here, Q[sb] [i] represents a quantized value of the ith transform coefficient belonging to subband #sb.

(S5) The Huffman encoder 17 selects an optimal Huffman codebook for the current subband #sb in the way described earlier in FIG. 8 and encodes Q[sb] [i] using the selected optimal Huffman codebook. The outcomes of this Huffman coding operation include Huffman codeword, Huffman codeword length, and optimal codebook number.

(S6) The codeword length accumulator 12*a* accumulates Huffman codeword lengths calculated up to the present subband #sb (i.e., #0, #2, . . . #sb). The codeword length accumulator 12*a* maintains this cumulative codeword length in a variable named "spec_bits." Since the subband number is incremented by two, spec_bits shows how many Huffman code bits have been produced so far for the even-numbered subbands.

(S7) The codebook number inserter 16 assigns the optimal codebook number of one subband #sb to another subband #(sb+1). Suppose, for example, that the Huffman encoder 17 has selected a Huffman codebook #1 for subband #0. The codebook number inserter 16 then assigns the same codebook number "#1" to the next subband #1. Likewise, suppose that the Huffman encoder 17 has selected a Huffman codebook #3 for subband #2. The codebook number inserter 16 then assigns the same codebook number "#3" to the next subband #3. What the codebook number inserter 16 is doing here is extending the codebook number of an even-numbered subband to an odd-numbered subband. The codebook number inserter 16 outputs the result as codebook number information N[m]. As will be seen later, the second stage of quantization does not include such insertion.

(S8) Based on the codebook number information N[m], the codebook number bit counter 12*b* calculates the total number of bits consumed to carry the codebook numbers of all subbands. The resulting sum is maintained in a variable named "book_bits." The codebook number bit counter 12*b* outputs this book_bits, together with codebook number run length information (described later in FIG. 20).

(S9) With CSF, SF[sb], and scale factor codebook B2, the scale factor bit counter 12*c* calculates the total number of bits consumed to carry scale factors of subbands #0, #1, #2, . . . #sb. The resulting sum is maintained in a variable called "sf_bits." The scale factor bit counter 12*c* outputs this sf_bits, together with Huffman codewords representing scale factors.

Figure 16:
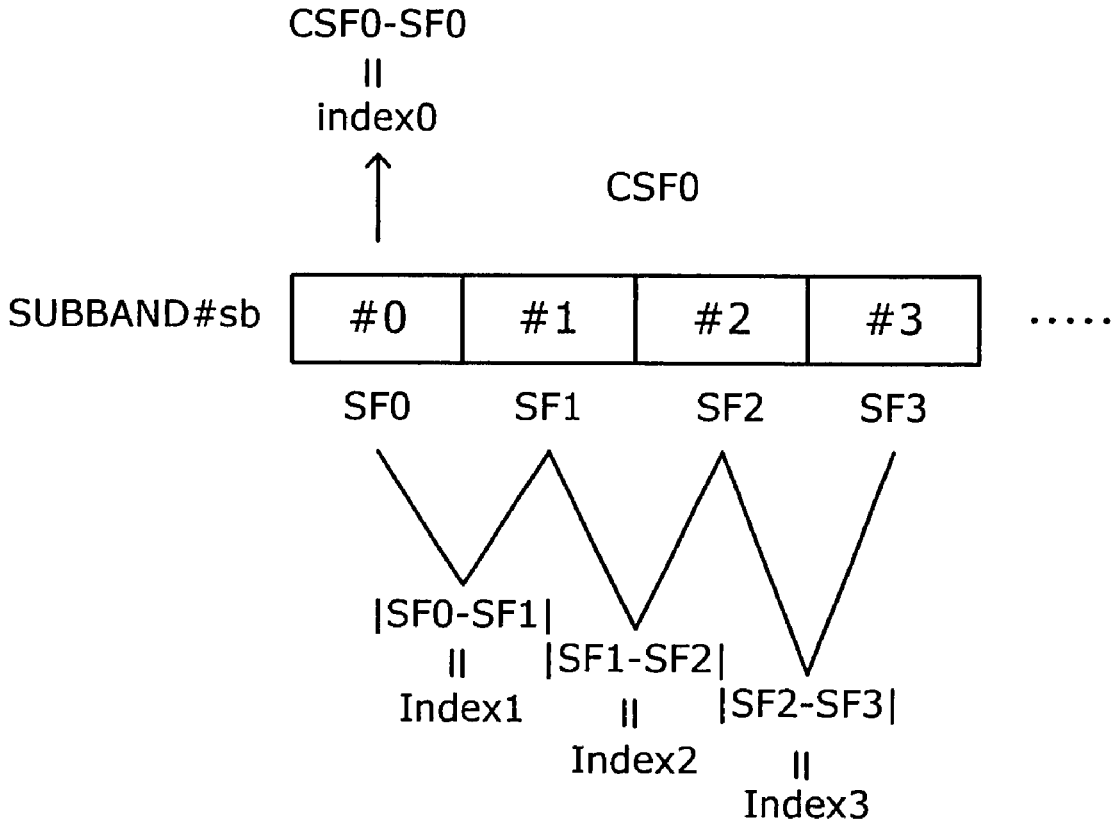
FIG. 16 gives an overview of how a scale factor bit count is calculated.

FIG. 16 gives an overview of how a scale factor bit count is calculated. This figure assumes individual scale factors SF0 to SF3 for subbands #0 to #3, in addition to a common scale factor CSF0. Scale factor codebook B2 is designed to give a Huffman codeword and its bit length corresponding to an index that is calculated as a difference between two adjacent subbands.

In the example of FIG. 16, subbands #0 to #3 have their respective indexes index0 to index3, which are calculated as follows:

$$index0=CSF0-SF0$$

$$index1=|SF0-SF1|$$

$$index2=|SF1-SF2|$$

$$index3=|SF2-SF3|$$

Scale factor codebook B2 then gives Huffman codewords corresponding to index0 to index3, together with their respective lengths.

(S10) Using formula (8), the total bit calculator 13*a* calculates sum_bits (total bit count estimate, i.e., the total number of bits to be consumed) by adding up two times spec_bits (cumulative codeword length), book_bits (codebook number bit count), and sf_bits (scale factor bit count), each calculated for every second subband, from #0 to the current subband number #sb.

$$sum_bits=2\times spec_bits+book_bits+sf_bits \quad (8)$$

Instead of quantizing every second subband, the process may quantize every nth subband. The total bit count estimate sum_bits in this generalized case is calculated by:

$$sum_bits=n\times spec_bits+book_bits+sf_bits \quad (8a)$$

Throughout this description, quantizing "every nth subband" means quantizing one subband out of every n subbands while skipping other intervening subbands. For example, the quantizer may quantize subbands #0, #2, #4, . . . (n=2); or subbands #0, #3, #6, . . . (n=3). While the quantizer starts with the lowest subband #0 in this example, the present invention should not be limited to that particular start position. Alternatively, the quantizer may quantize, for example, subbands #1, #3, #5, . . . (n=2); or subbands #1, #4, #7, . . . (n=3).

The following will give a more detailed discussion on the range of subbands where a bit count estimation takes place during the quantization of every nth subband. First, think of the case of n=2 (i.e., when quantizing every other subband) and suppose that the current subband number is #6. In this case, spec_bits has so far accumulated Huffman codeword lengths for four subbands #0, #2, #4, and #6. The total bit calculator 13*a* thus doubles spec_bits when it estimates sum_bits. This means that the estimated sum_bits appears as if it included bits for subband #7, although the reality is that the current subband number is still #6. By doubling spec_bits, the coverage of sum_bits is extended from seven subbands (#0 to #6) to eight subbands (#0 to #7). While the resulting estimate sum_bits contains some extra bits for that extended subband, this discrepancy is not a problem in itself. One reason for this is that the first stage of quantization intends to estimate bit consumption before the quantized values are really Huffman-coded. Another reason is the process already sacrifices the accuracy by subsampling subbands for estimation purposes.

Now think of the case of n=3 and suppose that the current subband number is #9. This means that spec_bits has so far accumulated Huffman codeword lengths for four subbands #0, #3, #6, and #9. The total bit calculator 13*a* thus triples spec_bits when it estimates sum_bits. This means that the estimated sum_bits appears as if it included bits for subbands up to #11, although the reality is that the current subband number is still #9. By tripling spec_bits, the coverage of sum_bits is eventually extended from ten subbands (#0 to #9) to twelve subbands (#0 to #11). While the resulting sum_bits contain some extra bits for two extended subbands, the effect of this error would be relatively small since increasing n means allowing more error in the estimate.

Referring back to the case of n=2, the total bit count estimate sum_bits for subbands #0 to #6 is a sum of the following values: two times the cumulative codeword length (spec_bits) of Huffman codewords for subbands #0, #2, #4, and #6); codebook number bit count (book_bits) of subbands #0, #1, #2, #3, #4, #5, and #6; and scale factor bit count (sf_bits) of subbands #0, #1, #2, #3, #4, #5, and #6.

(S11) The comparator 14 compares sum_bits with a bit count limit that is defined previously. If sum_bits is less than the limit, then the process updates the subband number #sb (i.e., increments it by two in the present example) and returns to step S3 to repeat the above-described operations for the newly selected subband. If sum_bits is equal to or greater than the bit count limit, then the process advances to step S12 without updating the subband number.

(S12) Now that the total bit count estimate (sum_bits) has reached the bit count limit during the quantization loop of S3 to S11, the CSF/SF corrector 15*a* finds that the parameters CSF and SF have to be corrected. The CSF/SF corrector 15*a* thus interrupts the loop and corrects those parameters so that sum_bits will not exceed the bit count limit.

The total bit count can be suppressed by reducing SF while increasing CSF. The foregoing formula. (2) indicates that the quantized value Q decreases with a smaller SF[sb] and a larger CSF. The decreased Q results in an increased number of Huffman codebooks for selection, meaning that there are more chances for Q to gain a shorter Huffman codeword. The shorter Huffman codeword permits more efficient data compression, thus making it possible to expand the frequency range.

The conventional parameter correction of ISO/IEC 13818-7 changes individual scale factors SF uniformly for the entire spectrum. According to the present invention, on the other hand, the CSF/SF corrector 15*a* assigns weights to individual subbands and modifies their SF with those weights. Specifically, the CSF/SF corrector 15*a* attempts to allocate more bits to a higher frequency range by reducing the bit count in a lower frequency range. Suppose, for example, that subbands #0 to #48 are classified into three frequency ranges: bass, midrange, and treble. The CSF/SF corrector 15*a* may modify the scale factors SF of those ranges differently. More specifically, the CSF/SF corrector 15*a* may add −2 to the current SF of each bass subband #0 to #9, −1 to the current SF of each midrange subband #10 to #29, and −1 to the current SF of each treble subband #30 to #48.

The quantization algorithm of the present invention starts with the lowest subband #0 in the bass range. The CSF/SF corrector 15*a* thus gives a larger correction to the bass range so as to reduce the quantized values Q of transform coefficients in that range. By so doing, the CSF/SF corrector 15*a* suppresses the number of bits consumed by the bass range while reserving more bits for the treble range. As a result, the audio coding device 10 can ensure its stable frequency response.

While individual scale factors SF affect quantized values of individual subbands, the common scale factor CSF affects those of the entire set of subbands. A large correction to CSF reduces quantized values across the entire frequency spectrum.

Referring now to the flowchart shown in FIG. 15, the following will explain S13 and subsequent steps. The steps shown in FIG. 15 are, however, similar to what the conventional ISO/IEC standard recommends. In short, steps S13 to S24 quantize one subband at a time, from the lowest subband toward upper subbands, using the CSF and SF parameters that have been determined as a result of steps S1 to S12 in the way proposed by the present invention. This process is referred to as a second stage of quantization. The second stage quantizes as many subbands as possible (i.e., as long as the cumulative bit consumption falls within a given budget).

(S13) The Huffman encoder 17 initializes optimal codebook numbers.

(S14) The quantization loop controller 20 initiates a second stage of quantization. Unlike the first stage performed at steps S3 to S11, the second stage never skips subbands, but processes every subband #0, #1, #2, #3, . . . in that order, by incrementing the subband number #sb by one.

(S15) The nonlinear quantizer 11*a* subjects transform coefficients in subband #sb (#0, #1, #2, . . . ) to a nonlinear quantization process. Specifically, with formula (2), the nonlinear quantizer 11*a* calculates quantized values Q[sb][i] of transform coefficients X using CSF and SF[sb].

(S16) The Huffman encoder 17 selects an optimal Huffman codebook for the current subband and encodes Q[sb][i] using the selected optimal Huffman codebook. The outcomes of this Huffman coding operation include Huffman codeword, Huffman codeword length, and optimal codebook number.

(S17) The codeword length accumulator 12*a* accumulates Huffman codeword lengths calculated up to the present subband #sb (i.e., #0, #1, . . . #sb). The codeword length accumulator 12*a* maintains this cumulative codeword length in spec_bits.

(S18) Based on the codebook number information, the codebook number bit counter 12*b* calculates the total number of bits consumed to carry the optimal Huffman codebook numbers of all subbands. The resulting sum is maintained in book_bits. The codebook number bit counter 12*b* output this book_bits, together with codebook number run length information.

(S19) With CSF, SF[sb], and scale factor codebook B2, the scale factor bit counter 12*c* calculates the total number of bits consumed to carry scale factors of subbands #0, #1, #2, . . . #sb. The resulting sum is maintained in sf_bits. The scale factor bit counter 12*c* outputs this sf_bits, together with Huffman codewords representing the scale factors.

(S20) The total bit calculator 13*a* calculates sum_bits with formula (8) where n=1.

(S21) The comparator 14 compares sum_bits with a bit count limit that is defined previously. If sum_bits exceeds the limit, the process advances to step S22. If not, the process proceeds to step S23.

(S22) The Huffman encoder 17 clears the optimal codebook number of subband #sb and proceeds to step S24.

(S23) The comparator 14 determines whether sum_bits is equal to the bit count limit. If sum_bits is not equal to the limit (i.e., sum_bits is within the limit), the process returns to step S14. If it is, then the process moves to step S24.

(S24) CSF and SF are converted. Specifically, SF[i] is replaced with CSF-SF[i]+OFFSET, and CSF is replaced with SF [0]. The quantization result including Huffman codewords, and bit counts are then stored.

Comparison with ISO/IEC Encoder

Figure 17:
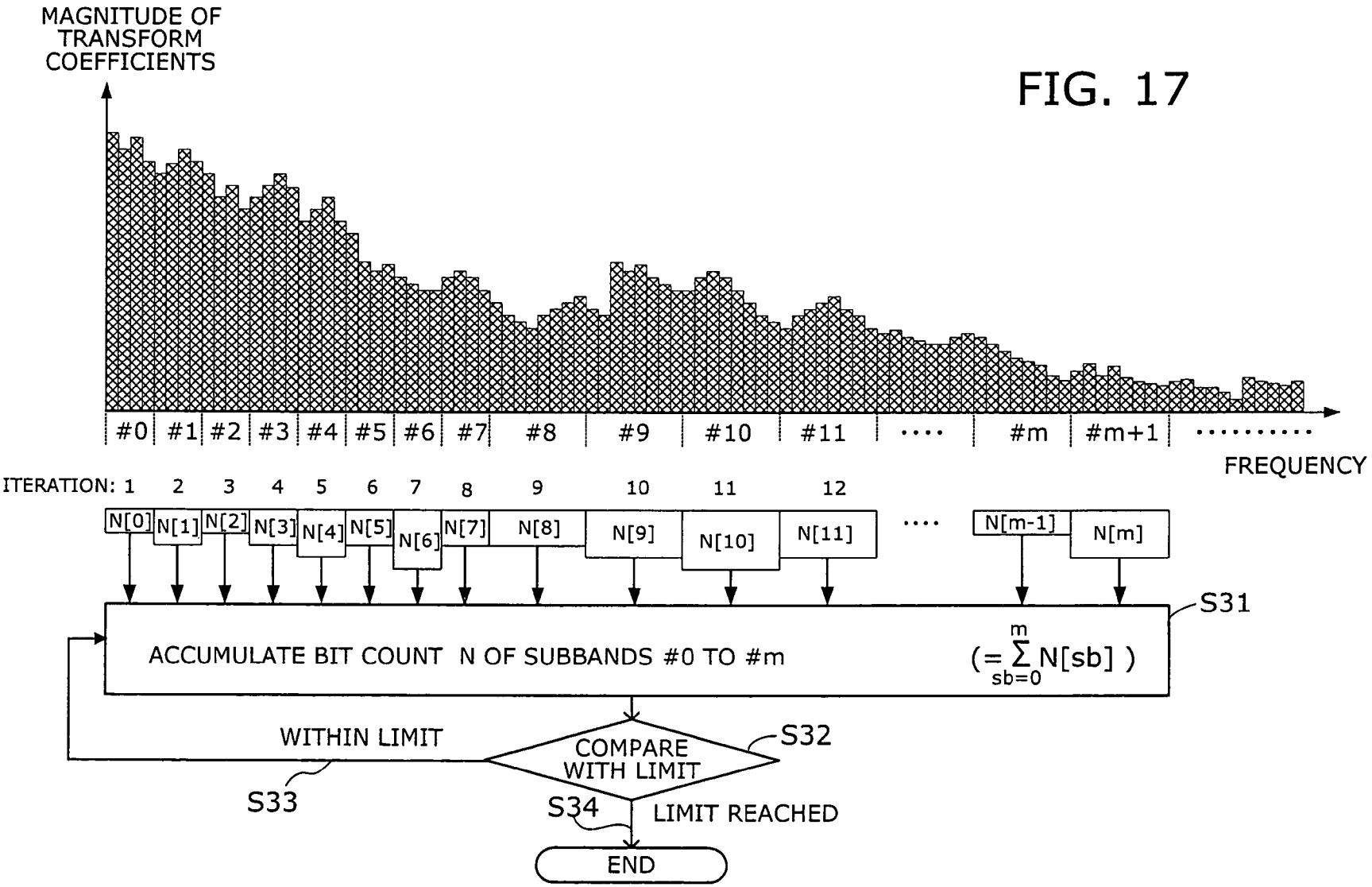
FIG. 17 gives an overview of a quantization process according to ISO/IEC 13818-7.
Figure 18:
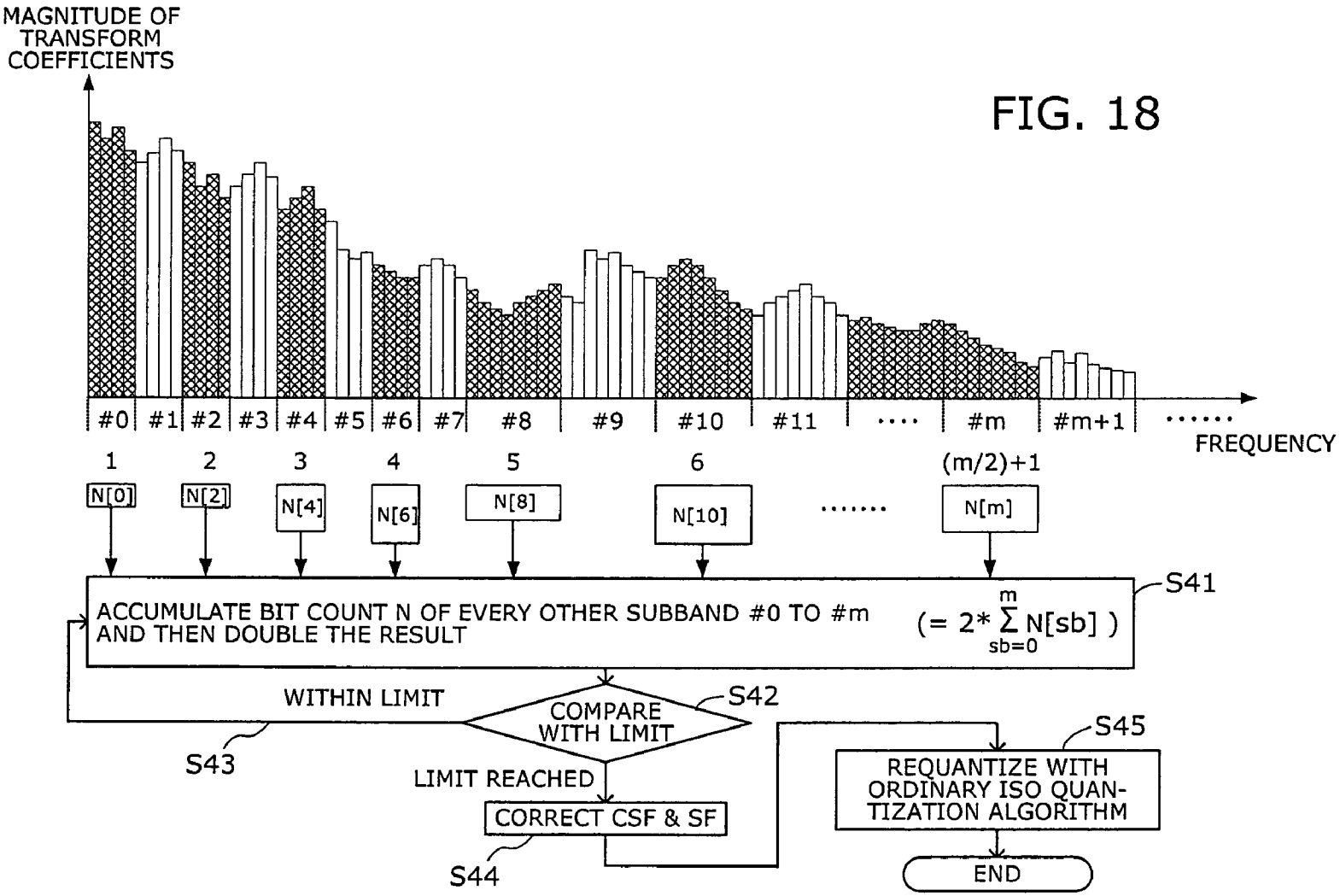
FIG. 18 shows an aspect of the proposed quantization process.

Referring to FIGS. 17 and 18, this section describes what differentiates the quantization process of the proposed audio coding device 10 from the conventional ISO/IEC standard. FIG. 17 gives an overview of a quantization process according to the ISO/IEC standard. This conventional quantization process counts the number of bits required for quantization of each subband, while incrementing the subband number by one as in #0, #1, #2, . . . (step S31). It then compares the resulting cumulative bit count with a bit count limit (step S32). If the former is smaller than the latter, the process continues accumulating bits (step S33). The quantization process ends when the cumulative bit count exceeds the bit count limit (step S34).

FIG. 18 depicts an aspect of quantization process of the audio coding device 10 according to the present invention. The audio coding device 10 executes a first stage of quantization in which the number of coded bits are accumulated for every other subband #0, #2, #4, and so on (step S41). The audio coding device 10 then compares the resulting cumulative bit count with a bit count limit (step S42). If the former is smaller than the latter, the process continues accumulating bits (step S43). If the cumulative bit count exceeds the bit count limit, the audio coding device 10 ends the first stage and corrects scale factors CSF and SF (step S44). Then using the corrected CSF and SF, the audio coding device 10 executes an ordinary quantization process according to the conventional ISO/IEC standard (step S45).

As can be seen from the above explanation, the audio coding device 10 has two stages of quantization loops, assuming close similarity between adjacent subbands in terms of the magnitude of frequency components.

In the first stage, the audio coding device 10 quantizes every other subband and calculates the number of coded bits. The resulting bit count is then doubled for the purpose of estimating total bit consumption up to the present subband. If this estimate exceeds the budget, then the CSF/SF corrector 15*a* corrects CSF and SF. If not, the audio coding device 10 will use the current CSF and SF parameters in the subsequent second-stage operations. In the second stage, the audio coding device 10 attempts to quantize every subband, from the lowest to the highest, using the CSF and SF parameters. The process continues until the cumulative bit count reaches the budget. In this way, the audio coding device 10 quickly optimizes quantization parameters (CSF and SF) for fast convergence of the iteration, thus achieving improvement in sound quality.

Codebook Number Insertion

This section focuses on the insertion of Huffman codebook numbers explained earlier in step S7 of FIG. 14. Suppose now that the nonlinear quantizer 11*a* quantizes every nth subband in the first stage, and that the optimal codebook number selected for the current subband #sb is identified by a codebook number "#a." The codebook number inserter 16 assigns the Huffman codebook #a not only to subband #sb, but also to other subbands #(sb+1), #(sb+2), . . . #(sb+n−1) which the Huffman encoder 17 skips.

Figures 19A, 19B, 19C:
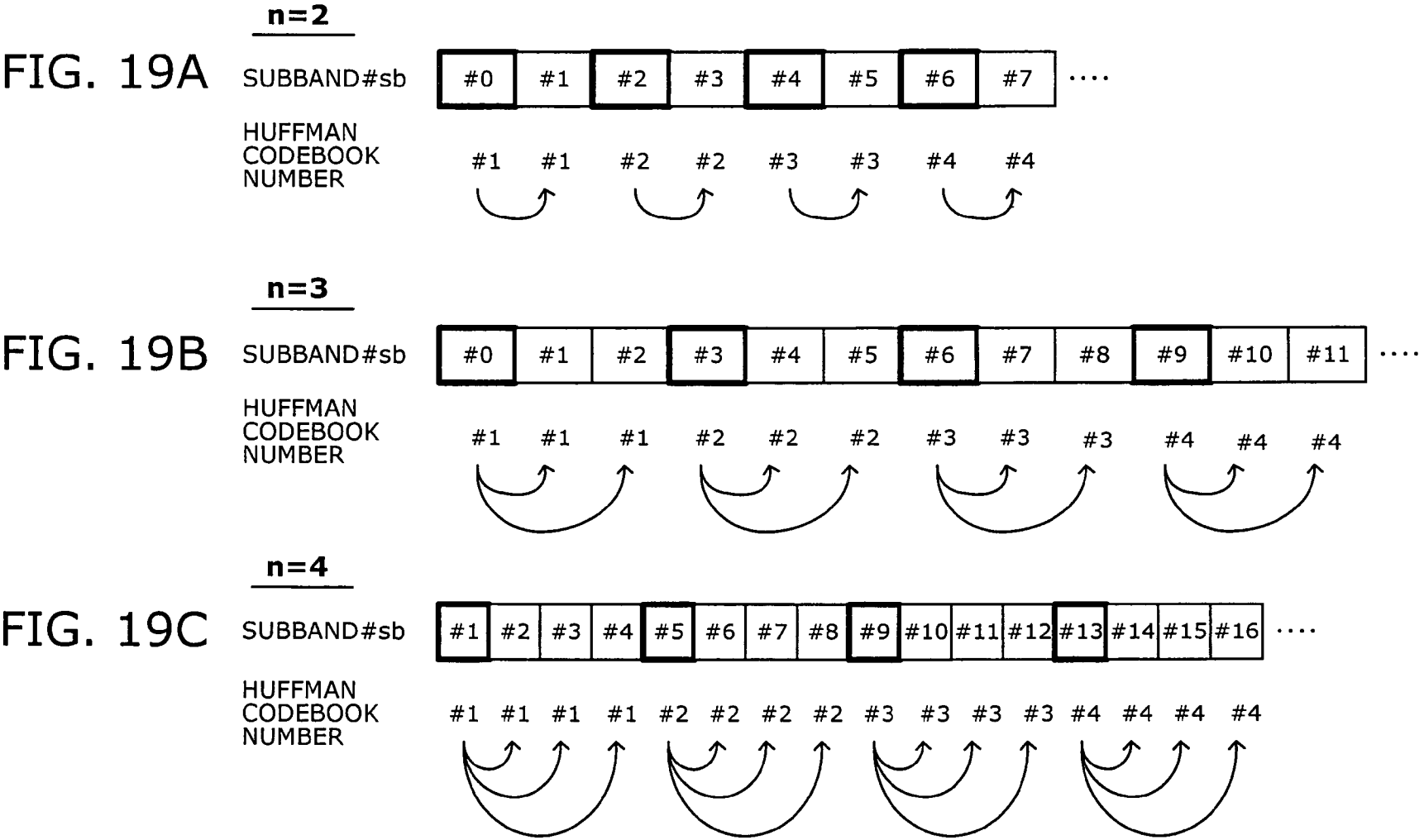
FIGS. 19A to 19C give an overview of codebook number insertion.

FIGS. 19A to 19C give an overview of codebook number insertion. Specifically, three examples are illustrated, where the nonlinear quantizer 11*a* has quantized every second subband (n=2, FIG. 19A), every third subband (n=3, FIG. 19B), or every fourth subband (n=4, FIG. 19C).

Referring first to the case of n=2 shown in FIG. 9A, the nonlinear quantizer 11*a* quantizes subbands #0, #2, #4, #6, and so on while skipping subbands #1, #3, #5, #7 and so on. Suppose now that Huffman codebooks #1, #2, #3, and #4 are selected for those quantized subbands #0, #2, #4, and #6 as their respective optimal codebooks. In this case, the codebook number inserter 16 assigns the same codebooks #1, #2, #3, and #4 to the skipped subbands #1, #3, #5, and #7, respectively. That is, the subbands #1, #3, #5, and #7 share their Huffman codebooks with their respective preceding subbands #0, #2, #4, and #6.

Referring to the case of n=3 shown in FIG. 9B, the nonlinear quantizer 11*a* quantizes subbands #0, #3, #6, #9, and so on while skipping other subbands between them. Suppose now that Huffman codebooks #1, #2, #3, and #4 are selected for those quantized subbands #0, #3, #6, and #9 as their respective optimal codebooks. In this case, the codebook number inserter 16 assigns codebook #1 to subbands #1 and #2, codebook #2 to subbands #4 and #5, codebook #3 to subbands #7 and #8, and codebook #4 to subbands #10 and #11. That is, the skipped subbands share their Huffman codebooks with their respective preceding subbands.

FIG. 9C shows the case of n=4, which just follows the same concept as described above, and thus no further explanation is provided here.

Figure 20:
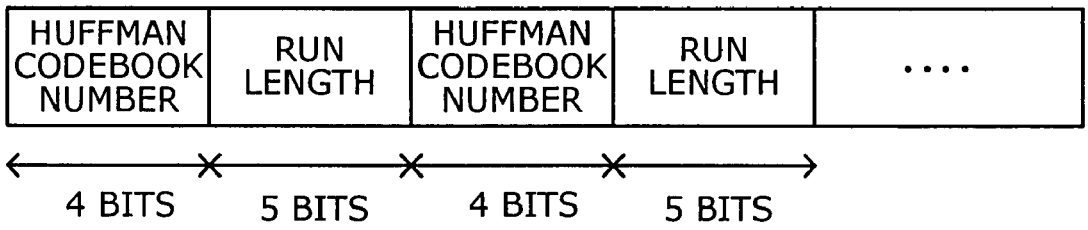
FIG. 20 shows a format of codebook number run length information.

The codebook number inserter 16 creates codebook number run length information to represent optimal codebook numbers of subbands in compressed form. FIG. 20 shows a format of codebook number run length information. The codebook number run length information is organized as a series of 9-bit data segments each formed from a 4-bit codebook number field and a 5-bit codebook number run length field.

Figure 21:
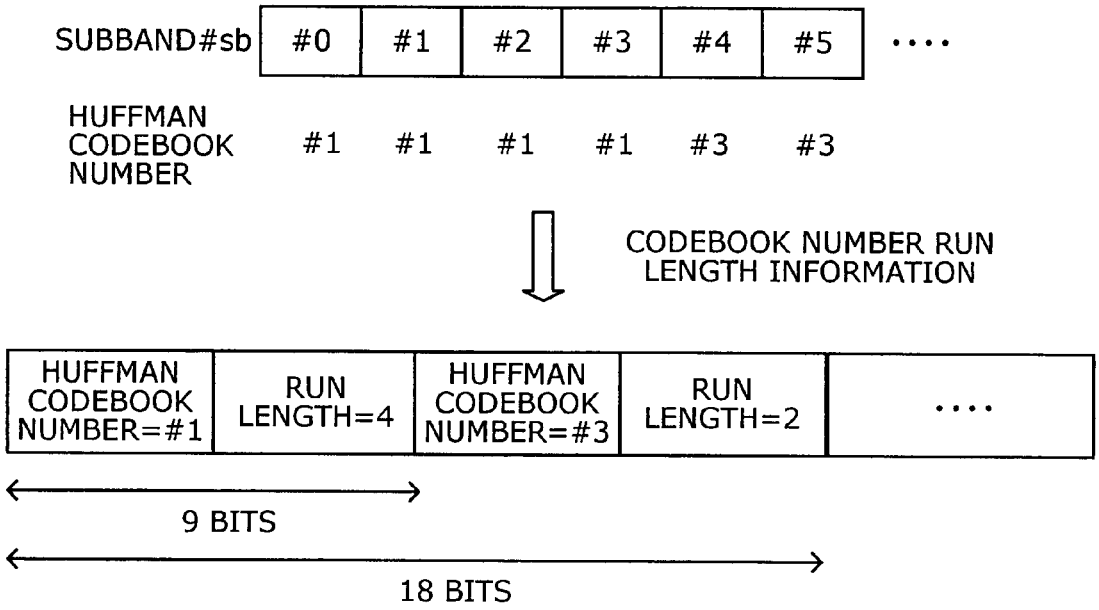
FIG. 21 shows an example of codebook number run length information.

FIG. 21 shows a specific example of codebook number run length information. This example assumes that the first four subbands #0 to #3 use Huffman codebook #1, and that the next two subbands #4 and #5 use codebook #3. In this case, the first codebook number field contains a codebook number "#1," which is followed by a codebook number run length field containing a value of "4" to indicate that the same codebook #1 is used in four consecutive subbands. The next codebook number field indicates another codebook number "#3," which is followed by another codebook number run length field containing a value of "12" to indicate that the same codebook #3 is used in two consecutive subbands.

As the above example shows, two or more consecutive subbands sharing the same codebook number consume only nine bits. In the case where two consecutive subbands use different codebooks, they consume eighteen bits.

Figure 22:
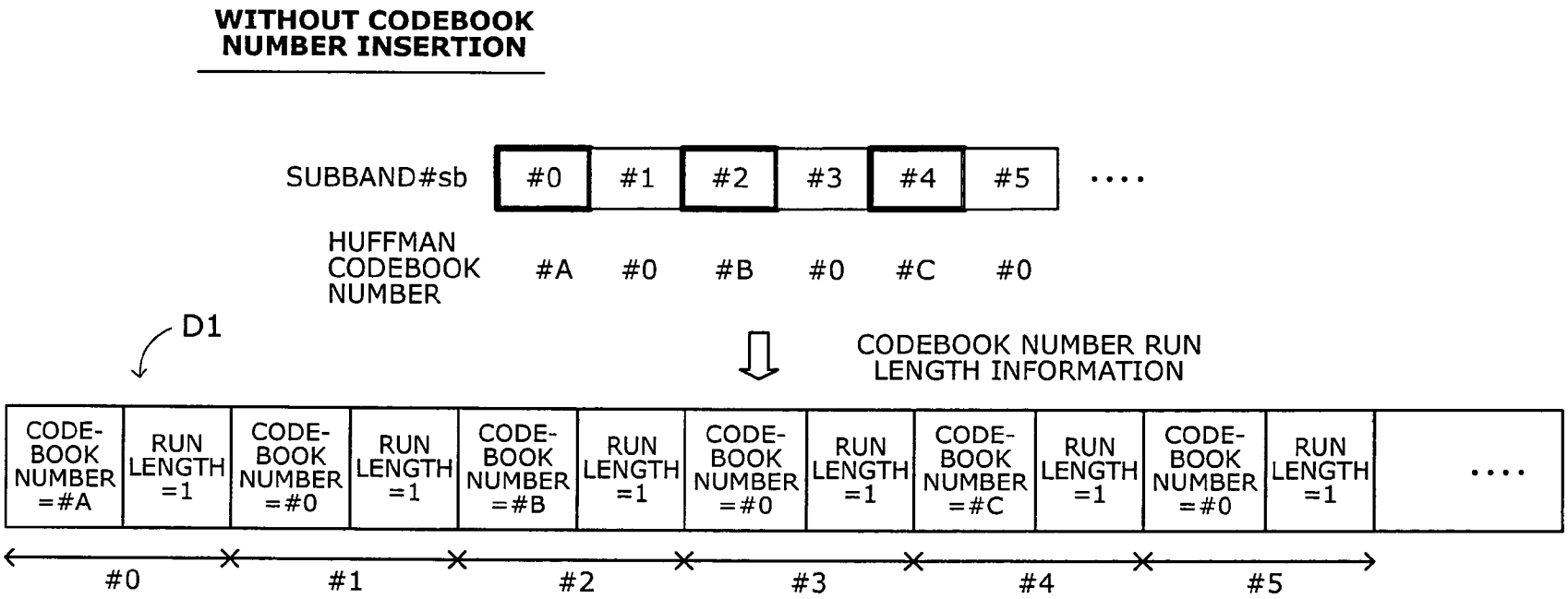
FIG. 22 shows codebook number run length information without codebook number insertion.
Figure 23:
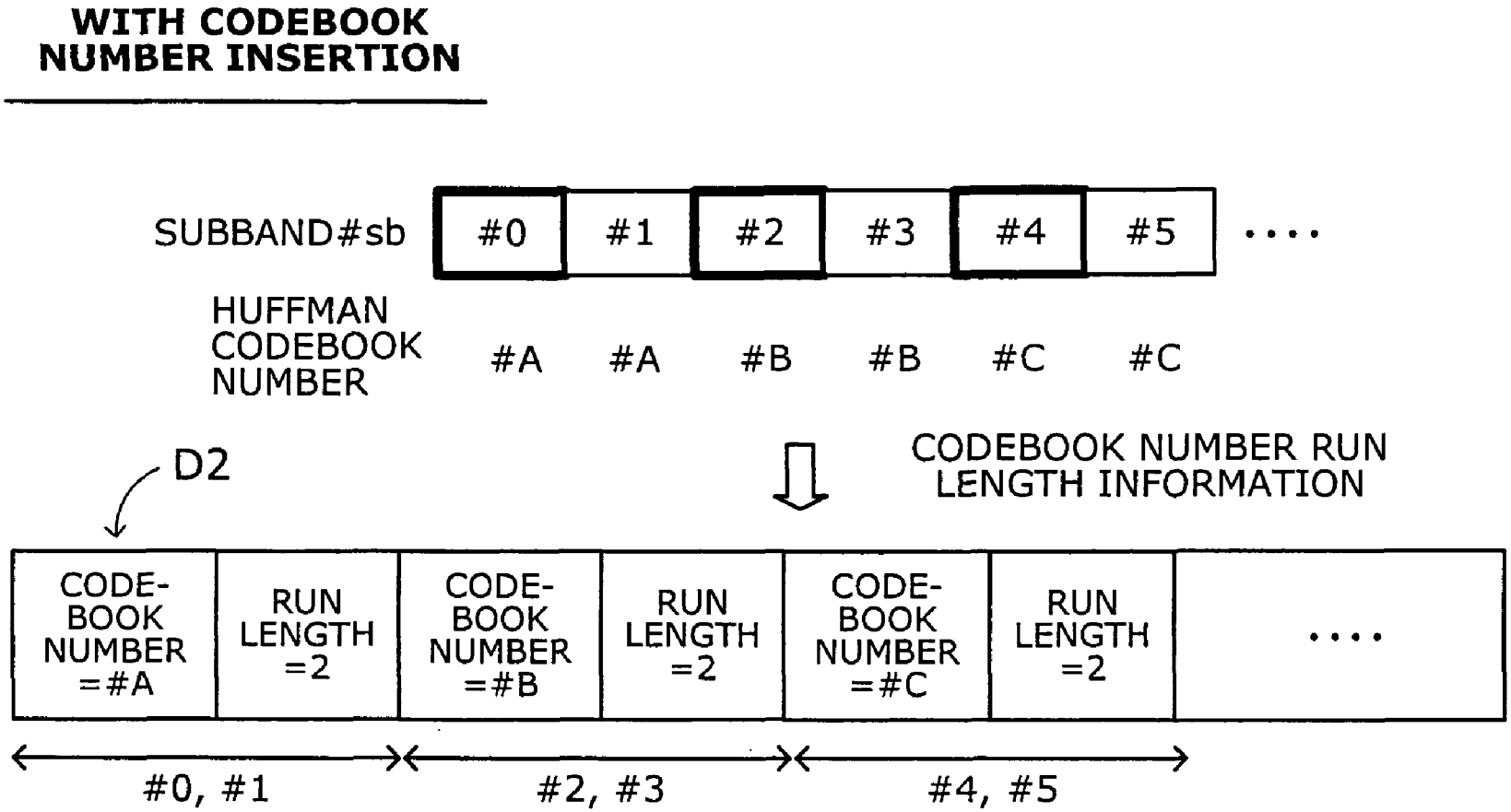
FIG. 23 shows codebook number run length information with codebook number insertion.

Referring now to FIGS. 22 and 23, the following will explain how the bit consumption may vary, depending on whether the foregoing codebook number insertion is applied or not. FIG. 22 shows codebook number run length information in the case where no codebook number insertion is performed. FIG. 23 shows the same in the case where codebook number insertion is applied. Both FIGS. 22 and 23 assume that Huffman codebooks #A, #B, and #C have been selected for subbands #0, #2, and #4 as their respective optimal codebooks.

In the example of FIG. 22, the Huffman codebook number of every subband were initialized to #0. While even-numbered subbands gain their Huffman codebook numbers later, the Huffman codebook numbers of odd-numbered subbands remain in the initialized state. The codebook number bit counter 12*b* would produce codebook number run length information D1 shown in FIG. 22 if the odd-numbered subbands preserved their initial codebook number #0.

In the example of FIG. 23, the codebook number inserter 16 fills in the gap of Huffman codebook numbers in subbands #1, #3, and #5 with numbers #A, #B, and #C, respectively. This action brings about codebook number run length information D2 shown in FIG. 23. Obviously the codebook number run length information D2 of FIG. 23 is far smaller in data size than D1 of FIG. 22. Without codebook number insertion, each skipped subband would consume superfluously nine bits for their codebook number information. The codebook number inserter 16 of the present invention assigns the same Huffman codebook number to two consecutive subbands, thus avoiding superfluous bit consumption and minimizing the codebook number bit count (book_bits).

Dynamic Parameter Correction

Figure 24A:
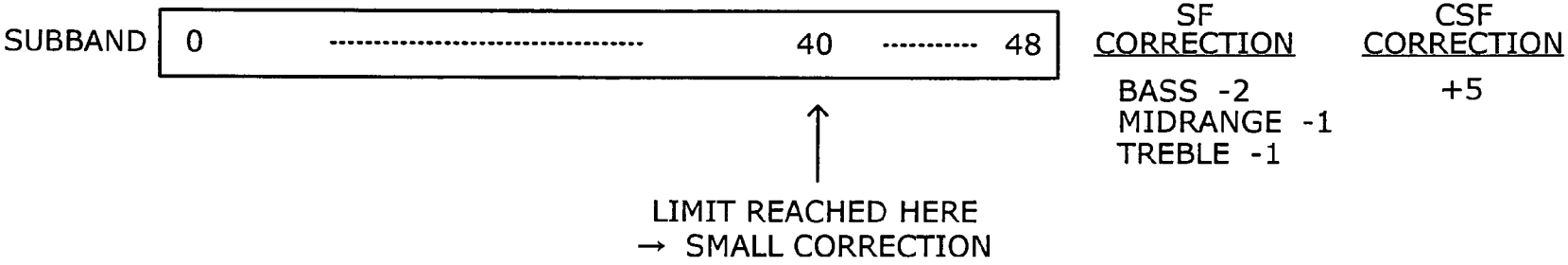
FIGS. 24A and 24B show dynamic correction of parameters.
Figure 24B:
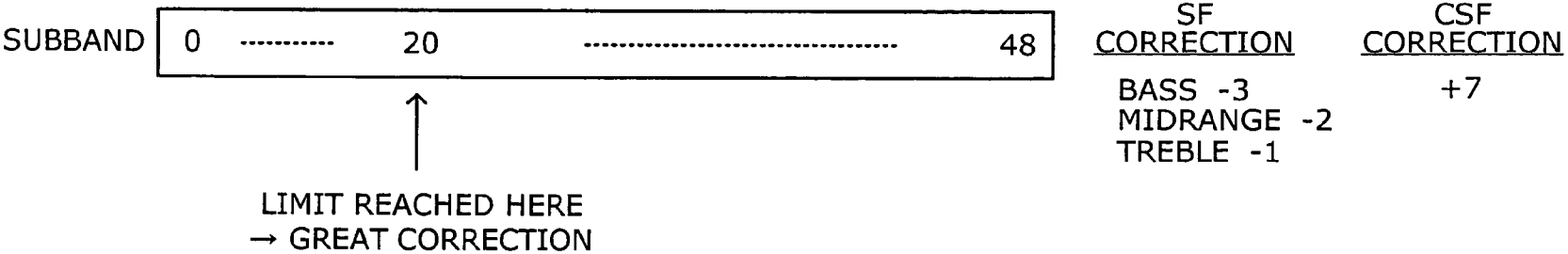

This section focuses on the CSF/SF corrector 15*a*, which provides the function of dynamically correcting quantization parameters SF and CSF. Specifically, the CSF/SF corrector 15*a* determines the amount of correction, depending on at which subband the total bit count estimate reaches a bit count limit. FIGS. 24A and 24B illustrate how this dynamic correction is performed.

Referring first to FIG. 24A, the CSF/SF corrector 15*a* makes a relatively small correction to SF and CSF when the bit count limit is reached at a higher subband (i.e., a subband with a larger subband number). Suppose, for example, that the total bit count estimate exceeds the limit as a result of quantization of subband #40. In this case, the CSF/SF corrector 15*a* adds −2 to individual scale factors SF of bass subbands, −1 to SF of midrange subbands, −1 to SF of treble subbands, and +5 to the common scale factor CSF.

Referring next to FIG. 24B, the CSF/SF corrector 15*a* makes a relatively large correction to SF and CSF parameters when the limit bit count is reached at a lower subband (i.e., a subband with a smaller subband number). Suppose, for example, that the total bit count estimate exceeds the limit as a result of quantization of subband #20. In this case, the CSF/SF corrector 15*a* adds −3 to SF of bass subbands, −2 to SF of midrange subbands, −1 to SF of treble subbands, and +7 to the common scale factor CSF.

As the above examples show, the amount of correction to SF and CSF may vary with the critical subband position at which the total bit count estimate reaches a bit count limit. This feature prevents quantization noise from increasing excessively and thus makes it possible to maintain the quality of sound.

The present invention reduces the amount of quantization processing in the case where SF and CSF require correction. As described above, the quantization process has to repeat the whole loops with corrected SF and CSF if the current SF and CSF parameters are found inadequate. In the worst case, this fact may be revealed at the very last subband. Since the conventional quantization increases the subband number by one (i.e., quantize every subband), the quantization process executes twice as many loops as the number of subbands. On the other hand, the proposed audio coding device 10 quantizes every other subband in an attempt to obtain a total bit count estimate. Since this stage of quantization involves only half the number of loop operations, the total amount of processing load can be reduced by 25 percent at most.

Figure 25:
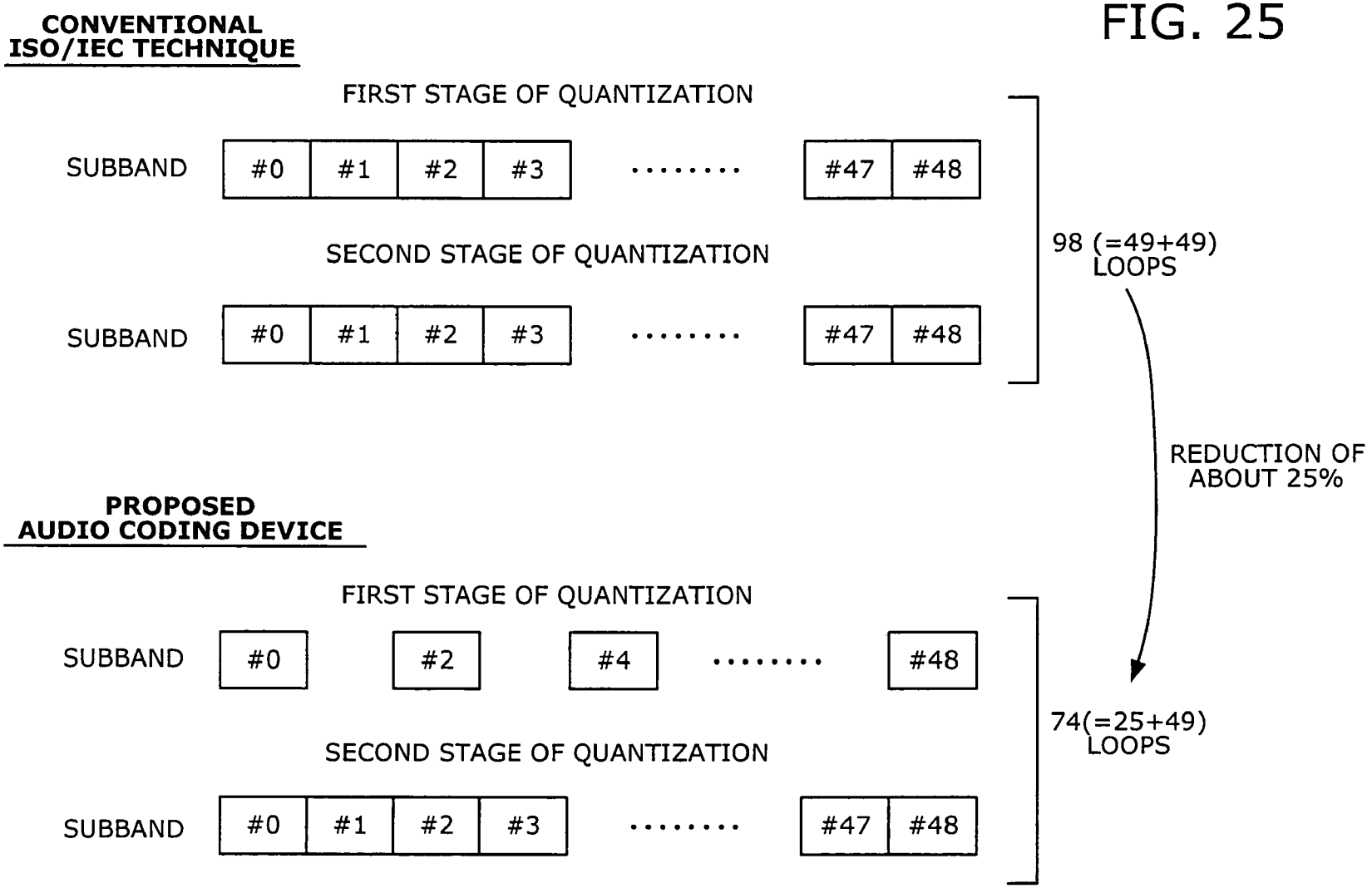
FIG. 25 gives a comparison between quantization according to the ISO standard and that of an audio coding device according to the present invention in terms of the amount of processing.

FIG. 25 gives a specific comparison between the quantization according to the conventional ISO/IEC technique and the audio coding device 10 according to the present invention in terms of the amount of processing. Suppose that the conventional quantization process has repeated 49 loops to quantize every subband #0 to #48 before it discovers that the total bit count exceeds the limit. The quantization process then correct its parameters and goes back to subbands #0 to #48, thus executing another 49 loop operations. Accordingly, the total number of executed loops amounts to 98 (=49×2).

The proposed audio coding device 10, on the other hand, quantizes only odd-numbered subbands #0, #2, . . . #48 in the first stage, which involves 25 loop operations. Suppose now that the audio coding device 10 has discovered that the total bit count exceeds the limit when the last subband #48 is finished. The audio coding device 10 thus corrects its parameters and goes back to subbands #0 to #48 and now executes the full 49 loop operations. The total number of executed loops in this case amounts to 74 (=25+49). This is about 25 percent smaller than 98, the total number of loops that the conventional quantization process involves.

Conclusion

As can be seen from the preceding discussion, the proposed audio coding device performs quantization in two stages. In the first stage, the audio coding device quantizes every nth subband, accumulates codeword lengths of Huffman codes corresponding to the quantized values, and calculates a total bit count estimate by adding up n times the cumulative codeword length and other bit counts related to the quantization. This mechanism quickly optimizes quantization parameters for fast convergence of iterative computation, thus achieving improved sound quality.

The present invention enables the quantizer to determine whether the final bit count falls with a given budget, without processing the full set of subbands. Since the quantizer needs to quantize only half the number of available subbands before it can make decision, it is possible to update the common and individual scale factors relatively earlier. This feature permits fast convergence of iterations in the quantization process and improves stability of the frequency spectrum, thus contributing to enhancement of sound quality.

The present invention also suppresses the peak requirement for computational power, thus smoothing out the processing load of the entire system. This feature is particularly beneficial for cost-sensitive, embedded system applications since it enables a less powerful processor to execute realtime tasks.

While the foregoing embodiments increment the subband number by two in each quantization loop, the present invention is not limited to that specific increment. The increment may be three, four, or more, depending on the implementations. The larger the increment is, the quicker the estimation of bit count will be. Note that the selection of this increment size will affect the way of codebook number insertion.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An apparatus for coding audio signals, comprising:

a device comprising:

a quantizer that quantizes spectrum signals in each subband to produce quantized values;

a quantized bit counter that calculates at least a codeword length representing the number of bits of a Huffman codeword corresponding to the quantized values and accumulates the calculated codeword length into a cumulative codeword length;

a bit count estimator that calculates a total bit count estimate representing how many bits will be produced as result of quantization, based on the cumulative codeword length and other bit counts related to the quantization;

a comparator that determines whether the total bit count estimate falls within a bit count limit; and a parameter updater that updates quantization parameters including a common scale factor and individual scale factors when the total bit count estimate exceeds the bit count limit;

wherein:

the apparatus executes quantization in first and second stages;

in the first stage, the quantizer quantizes every nth subband, where n is greater than 1;

in the first stage, the quantized bit counter accumulates codeword lengths corresponding to the quantized values that the quantizer has produced for every nth subband; and in the first stage, the bit count estimator calculates the total bit count estimate by adding up n times the cumulative codeword length and the other bit counts.

2. The apparatus according to claim 1, wherein the quantized bit counter calculates the other bit counts including:

a codebook number bit count representing a total number of bits required to carry optimal Huffman codebook numbers assigned to the subbands, and a scale factor bit count representing a total number of bits required to carry scale factors of the subband; and wherein the bit count estimator calculates, in the first stage, the total bit count estimate by adding up n times the cumulative codeword length, the codebook number bit count, and the scale factor bit count.

3. The apparatus according to claim 2, wherein:

in the second stage, the quantizer quantizes every subband using the quantization parameters updated in the first stage;

in the second stage, the quantized bit counter accumulates codeword lengths corresponding to the quantized values that the quantizer has produced for every subband; and in the second stage, the bit count estimator calculates the total bit count estimate by adding up the cumulative codeword length, the codebook number bit count, and the scale factor bit count.

4. The apparatus according to claim 2, further comprising a codebook number inserter that assigns a codebook number #a to subbands #(sb+1) to #(sb+n−1), where #a represents an optimal Huffman codebook selected for subband #sb.

5. The apparatus according to claim 1, wherein:

the subbands are classified into bass subbands, midrange subbands, and treble subbands according to frequency ranges thereof; and the parameter updater gives different correction values to the bass, midrange, and treble subbands when updating the individual and common scale factors.

6. The apparatus according to claim 5, wherein:

the parameter updater increases the correction values applied to the individual and common scale factors when the total bit count estimate reaches the bit count limit at a subband belonging to the bass subbands; and the parameter updater decreases the correction values applied to the individual and common scale factors when the total bit count estimate reaches the bit count limit at a subband belonging to the treble subbands.

7. A method of coding audio signals, comprising:

(a) a first stage of operations, comprising:

quantizing spectrum signals in every nth subband to produce quantized values, where n is greater than 1;

calculating a codeword length representing the number of bits of each Huffman codeword corresponding to the quantized values of every nth subband;

accumulating the codeword length into a cumulative codeword length;

calculating a total bit count estimate representing how many bits will be produced as result of quantization, by adding up n times the cumulative codeword length and other bit counts related to quantization;

determining whether the total bit count estimate falls within a bit count limit; and updating quantization parameters including a common scale factor and individual scale factors when the total bit count estimate exceeds the bit count limit; and (b) a second stage of operations, comprising:

quantizing spectrum signals by using the updated common scale factor and individual scale factors.

8. The method according to claim 7, wherein the other bit counts include:

a codebook number bit count representing a total number of bits required to carry optimal Huffman codebook numbers assigned to the subbands, and a scale factor bit count representing a total number of bits required to carry scale factors of the subband.

9. The method according to claim 8, wherein:

in the second stage of operations, said quantizing quantizes every subband; and the second stage of operations further comprises:

accumulating a codeword length corresponding to the quantized values of every subband into a cumulative codeword length, and calculating a total bit count estimate by adding up the cumulative codeword length, the codebook number bit count, and the scale factor bit count.

10. The method according to claim 7, further comprising the process of assigning a codebook number #a to subbands #(sb+1) to #(sb+n−1), where #a represents an optimal Huffman codebook selected for subband #sb.

11. The method according to claim 7, wherein:

the subbands are classified into bass subbands, midrange subbands, and treble subbands according to frequency ranges thereof; and said updating gives different correction values to the bass, midrange, and treble subbands when updating the individual and common scale factors.

12. The method according to claim 11, wherein:

said updating increases the correction values applied to the individual and common scale factors when the total bit count estimate reaches the bit count limit at a subband belonging to the bass subbands; and said updating decreases the correction values applied to the individual and common scale factors when the total bit count estimate reaches the bit count limit at a subband belonging to the treble subbands.

* * * * *